US012441506B2

(12) United States Patent
Ball

(10) Patent No.: US 12,441,506 B2
(45) Date of Patent: Oct. 14, 2025

(54) SHOEBOX

(71) Applicant: Pratt Corrugated Holdings, Inc., Brookhaven, GA (US)

(72) Inventor: Randy Ball, Peachtree City, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 406 days.

(21) Appl. No.: 17/667,199

(22) Filed: Feb. 8, 2022

(65) Prior Publication Data

US 2023/0249869 A1 Aug. 10, 2023

(51) Int. Cl.
*B65D 5/30* (2006.01)
*B65D 5/20* (2006.01)

(52) U.S. Cl.
CPC ..... *B65D 5/301* (2013.01); *B65D 5/2057* (2013.01)

(58) Field of Classification Search
CPC ..... B65D 5/301; B65D 5/2057; B65D 5/546; B65D 5/6652; B65D 5/22; B65D 5/6664; B65D 5/6608; B65D 5/5435; B65D 5/6658; B65D 2301/00; B65D 2251/1025; B65D 2517/0013
USPC ..... 206/299, 807, 140; 229/102, 148, 149, 229/198.2, 125.31, 151, 150, 155, 158, 229/194
See application file for complete search history.

(56) References Cited

U.S. PATENT DOCUMENTS 636,806 A 11/1899 Johnstone
916,503 A 3/1909 Thompson
1,108,464 A 8/1914 Morey
1,277,459 A 9/1918 Myers
1,306,574 A 6/1919 Boerlin
1,470,141 A 10/1923 Bryson
1,530,644 A 3/1925 Blandford
1,765,964 A 6/1930 Berton
1,987,545 A 1/1935 Alexander
2,028,677 A 1/1936 Lupton
2,044,701 A 6/1936 Junkin
2,060,240 A 11/1936 Pergande
2,228,181 A 1/1941 Perryman
2,572,159 A 10/1951 Kells et al.
(Continued)

FOREIGN PATENT DOCUMENTS

CN 116368070 A 6/2023
DE 2846467 5/1980
(Continued)

OTHER PUBLICATIONS

US D1,036,252 S, 07/2024, Ball (withdrawn)
(Continued)

*Primary Examiner* — Christopher R Demeree
(74) *Attorney, Agent, or Firm* — Taylor Duma LLP

(57) ABSTRACT

A shoebox includes a first main panel; a second main panel opposite the first main panel; a first connecting panel extending from the first main panel, the first connecting panel defining a locking slot; a second connecting panel extending between the first main panel and the second main panel opposite the first connecting panel; an overlapping panel extending from the second connecting panel and at least partially overlapping the first connecting panel; and a locking tab extending from the overlapping panel, the locking tab in locking engagement with the locking slot in a closed and locked configuration of the shoebox.

19 Claims, 11 Drawing Sheets

(56) References Cited

U.S. PATENT DOCUMENTS 2,834,531 A 5/1958 Struble
2,846,132 A 8/1958 Carpenter
D196,883 S 11/1963 Robinson
3,225,914 A 12/1965 Klein
3,233,818 A 2/1966 Bixler
3,235,167 A 2/1966 Svensson
3,263,899 A 8/1966 Collura et al.
3,356,282 A 12/1967 Layne, Sr.
3,451,535 A 6/1969 Caplan
D214,879 S 8/1969 Roccaforte et al.
3,462,066 A 8/1969 Farquhar
D215,414 S 9/1969 Roccaforte
3,512,823 A 5/1970 D'Esposito
3,580,482 A 5/1971 Witte
3,690,542 A 9/1972 Jernstrom
3,827,624 A * 8/1974 Dogliotti ..... B65D 5/6655 229/149
3,949,931 A 4/1976 Hall
4,046,311 A 9/1977 Voytko
4,428,525 A * 1/1984 Brauner ..... B65D 5/66 229/148
4,471,902 A 9/1984 Skaggs
4,516,718 A 5/1985 Forbes
4,600,140 A 7/1986 Milliens
4,607,786 A * 8/1986 Weaver ..... B65D 5/0254 229/149
4,752,028 A 6/1988 Ogura
4,765,535 A 8/1988 Michetti
4,830,270 A 5/1989 Holmes
4,953,779 A 9/1990 Densen
5,000,374 A 3/1991 Deiger
5,139,195 A 8/1992 McClure
5,232,087 A 8/1993 Schluger
5,259,552 A 11/1993 Kuchenbecker
5,263,634 A 11/1993 Korine
5,350,108 A 9/1994 Friar et al.
5,368,225 A 11/1994 Ritter
5,402,929 A 4/1995 Ritter et al.
5,452,845 A 9/1995 Ritter
5,507,428 A 4/1996 Robinson et al.
5,522,538 A 6/1996 Gray
5,535,940 A 7/1996 Olds
5,722,585 A 3/1998 Redl
5,740,958 A 4/1998 Cai
D394,383 S 5/1998 Bradfield
5,799,864 A 9/1998 Mertz
5,803,345 A 9/1998 Jones et al.
5,842,632 A 12/1998 Van Hest
5,875,961 A 3/1999 Stone et al.
5,918,797 A 7/1999 Correll
5,941,453 A * 8/1999 Oliff ..... B65D 5/4279 229/198.2
D432,912 S 10/2000 Lubineau-Bigot et al.
D433,630 S 11/2000 Lubineau-Bigot et al.
6,206,277 B1 3/2001 Correll
6,223,979 B1 5/2001 Correll
6,290,122 B1 9/2001 Correll
D449,520 S 10/2001 DiZoglio, III
6,364,199 B1 4/2002 Rose
6,398,028 B1 6/2002 Stovall
6,401,971 B1 6/2002 Edwards et al.
6,685,085 B2 2/2004 Hanna
6,715,805 B1 4/2004 Ågren
D496,269 S 9/2004 Hutchinson
6,868,964 B2 3/2005 Carty et al.
6,889,891 B2 5/2005 Correll
6,922,976 B2 8/2005 Correll
6,997,372 B2 * 2/2006 Gasparowicz ..... B65D 71/18 206/427
D569,719 S 5/2008 Ross
D592,968 S 5/2009 Lee et al.
7,578,393 B2 8/2009 Gillon
D601,419 S 10/2009 Sant' Ana Caceres et al.
D613,153 S 4/2010 Russell
D628,065 S 11/2010 Russell
D649,040 S 11/2011 Sanders
8,162,206 B2 4/2012 Harrelson
8,408,451 B2 4/2013 Adam et al.
D696,107 S 12/2013 Kimple et al.
8,608,050 B2 12/2013 Seliger et al.
D699,101 S 2/2014 Strom et al.
D707,123 S 6/2014 Marchetti et al.
D735,576 S 8/2015 Aldridge
9,327,866 B2 5/2016 Strom et al.
D758,851 S 6/2016 Binder et al.
D764,280 S 8/2016 Carnu
D767,989 S 10/2016 Nietert et al.
9,481,486 B2 * 11/2016 Nameth ..... B65D 5/5435
9,522,761 B2 12/2016 Baker et al.
9,694,837 B2 7/2017 Ryan
D798,709 S 10/2017 Chen
9,878,818 B2 1/2018 Grajales et al.
10,017,292 B1 7/2018 Anderson et al.
D831,330 S 10/2018 Kim et al.
10,086,972 B2 10/2018 Hajek
D834,411 S 11/2018 Vanderhulst et al.
10,118,726 B2 11/2018 James et al.
D848,835 S 5/2019 Exner et al.
10,364,062 B2 7/2019 Bressan et al.
D859,984 S 9/2019 Li et al.
D863,958 S 10/2019 Tidwell et al.
D866,312 S 11/2019 Ito
10,486,850 B1 * 11/2019 Cook ..... B65D 5/6623
D873,657 S 1/2020 Barker
D874,921 S 2/2020 Zhao
D875,521 S 2/2020 Elman
D876,819 S 3/2020 Kim et al.
D888,551 S 6/2020 Kim
D892,632 S 8/2020 Bogdziewicz
10,787,288 B1 9/2020 Garthaffner
D911,833 S 3/2021 Toroyan
D914,495 S 3/2021 Wikstrom
11,180,278 B2 11/2021 Bressan et al.
11,225,354 B2 1/2022 Dixon
11,230,404 B2 1/2022 Sollie et al.
D946,768 S 3/2022 Kemper et al.
11,286,081 B2 3/2022 Collis et al.
11,319,140 B2 5/2022 Modha et al.
D955,875 S 6/2022 Sill et al.
11,377,252 B2 7/2022 Borst, Sr. et al.
D964,851 S 9/2022 Aloisio et al.
D965,433 S 10/2022 Wikstrom
D968,950 S 11/2022 Sollie et al.
11,511,921 B1 11/2022 Wikstrom et al.
D977,966 S 2/2023 Fang
D977,967 S 2/2023 Sollie et al.
D981,873 S 3/2023 Valentine
11,661,246 B2 5/2023 Sill et al.
11,731,800 B2 8/2023 Borst, Sr. et al.
D1,005,097 S 11/2023 Strasser
11,840,379 B2 12/2023 Humberstone et al.
11,919,686 B1 3/2024 Jackson et al.
11,939,121 B2 * 3/2024 Donschietz ..... B65D 75/5805
11,945,627 B2 4/2024 Borst, Sr. et al.
11,993,428 B2 5/2024 Mayer
D1,032,358 S 6/2024 Walters et al.
D1,033,214 S 7/2024 Tao et al.
D1,036,990 S 7/2024 Gonzalez Manzano
D1,037,847 S 8/2024 Borst, Sr. et al.
D1,045,598 S 10/2024 Sill et al.
D1,052,397 S 11/2024 Ball
12,162,657 B2 12/2024 Humberstone et al.
12,172,806 B2 12/2024 Humberstone et al.
D1,056,702 S 1/2025 Ball
D1,057,557 S 1/2025 Humberstone et al.
D1,060,029 S 2/2025 Mayer
D1,085,872 S 7/2025 Borst, Sr. et al.
12,365,509 B2 7/2025 Humberstone et al.
D1,088,859 S 8/2025 Ball
2003/0163978 A1 9/2003 Correll
2005/0103832 A1 5/2005 Correll
2007/0228130 A1 10/2007 Arai
2009/0057387 A1 3/2009 Tirado Alanis

(56) References Cited

U.S. PATENT DOCUMENTS

| | | | |
|---|---|---|---|
| 2010/0006634 | A1 | 1/2010 | Vogel |
| 2011/0136641 | A1 | 6/2011 | Lee et al. |
| 2012/0234904 | A1 | 9/2012 | Costanzo, Jr. |
| 2014/0263601 | A1 | 9/2014 | Graham |
| 2016/0001937 | A1 | 1/2016 | Skinner |
| 2016/0107785 | A1 | 4/2016 | Sato et al. |
| 2016/0144996 | A1 | 5/2016 | Kagawa et al. |
| 2016/0194111 | A1 | 7/2016 | Sharon et al. |
| 2017/0202401 | A1 | 7/2017 | Mortell |
| 2017/0297802 | A1 | 10/2017 | Davis et al. |
| 2017/0297803 | A1 | 10/2017 | Chambers et al. |
| 2017/0313464 | A1 | 11/2017 | McCarthy et al. |
| 2017/0362008 | A1 | 12/2017 | Theodorakos |
| 2018/0170610 | A1 | 6/2018 | Buss |
| 2019/0100346 | A1 | 4/2019 | Bressan et al. |
| 2019/0248536 | A1 | 8/2019 | Foushee |
| 2019/0300224 | A1 | 10/2019 | Jiang et al. |
| 2019/0344927 | A1 | 11/2019 | Ozgercel |
| 2020/0017286 | A1 | 1/2020 | Barker |
| 2020/0391903 | A1 | 12/2020 | Donschietz et al. |
| 2021/0078755 | A1 | 3/2021 | Sollie et al. |
| 2021/0371153 | A1 | 12/2021 | Borst, Sr. et al. |
| 2022/0017263 | A1 | 1/2022 | Wikstrom |
| 2022/0055794 | A1 | 2/2022 | Humberstone et al. |
| 2022/0289423 | A1 | 9/2022 | Borst, Sr. et al. |
| 2023/0249897 | A1 | 8/2023 | Forsberg |
| 2023/0312159 | A1 | 10/2023 | Borst, Sr. et al. |
| 2023/0312164 | A1 | 10/2023 | Humberstone et al. |
| 2023/0312165 | A1 | 10/2023 | Humberstone et al. |
| 2023/0312218 | A1 | 10/2023 | Wu et al. |
| 2023/0331430 | A1 | 10/2023 | Valance |
| 2024/0300692 | A1 | 9/2024 | Donschietz et al. |
| 2024/0336394 | A1 | 10/2024 | Sanders et al. |
| 2025/0051090 | A1 | 2/2025 | Coles |
| 2025/0091759 | A1 | 3/2025 | Humberstone et al. |

FOREIGN PATENT DOCUMENTS

| | | |
|---|---|---|
| DE | 102008037953 | 4/2009 |
| EP | 0936152 | 12/2003 |
| EP | 1992574 | 11/2008 |
| FR | 2504892 | 11/1982 |
| GB | 472474 | 9/1937 |
| GB | 2227731 | 8/1990 |
| GB | 2305653 | 4/1997 |
| GB | 2328201 | 2/1999 |
| GB | 2456838 | 7/2009 |
| JP | 7493078 B2 | 5/2024 |
| KR | 301122910.0000 | 8/2021 |
| WO | 2013007306 | 1/2013 |

OTHER PUBLICATIONS

Borst Sr., Kendrick Michael; Notice of Allowance for U.S. Appl. No. 17/830,020, filed Jun. 1, 2022, mailed Mar. 9, 2023, 9 pgs.
Borst Sr., Kendrick Michael; Notice of Allowance for U.S. Appl. No. 16/915,556, filed Jun. 29, 2020, mailed Mar. 3, 2022, 10 pgs.
Borst Sr., Kendrick Michael; Applicant-Initiated Interview Summary for U.S. Appl. No. 16/915,556, filed Jun. 29, 2020, mailed Aug. 30, 2021, 2 pgs.
Borst Sr., Kendrick Michael; Non-Final Office Action for U.S. Appl. No. 16/915,556, filed Jun. 29, 2020, mailed Jun. 30, 2021, 13 pgs.
Borst Sr., Kendrick Michael; Notice of Allowance for U.S. Appl. No. 16/915,556, filed Jun. 29, 2020, mailed Feb. 3, 2022, 13 pgs.
Borst, Sr., Kendrick Michael; Requirement for Restriction/Election for U.S. Appl. No. 16/915,556, filed Jun. 29, 2020, mailed May 4, 2021, 6 pgs.
Tredhunter.com; Article entitled: "Tamper-Proof Pizza Boxes", located at <https://www.trendhunter.com/trends/tamper-proof-pizza-box>, accessed on May 11, 2020, 6 pgs.
Humberstone, Robert F.; Requirement for Restriction/Election for U.S. Appl. No. 17/001,016, filed Mar. 24, 2020, mailed Feb. 23, 2022, 6 pgs.
Shpkg.com; Article entitled: "Single Layer Corrugated Box", available at <https://www.shpkg.com/product/Kraft-Sealing-Box-For-Cosmetic.html>, accessed on Sep. 16, 2021, 15 pgs.
Locktheboxes.com; Article entitled: "Lock the Boxes", accessed on May 11, 2020, 6 pgs.
Pizzaloc; Article entitled: "PizzaLoc tamper-evident fastener", located ay <https://www.pizzaloc.com/>, publicly available prior to May 28, 2020, 6 pgs.
Humberstone, Robert F.; Notice of Allowance for U.S. Appl. No. 18/205,401, filed Jun. 2, 2023, mailed Mar. 22, 2024, 9 pgs.
Humberstone, Robert F.; Notice of Allowance for U.S. Appl. No. 18/205,403, filed Jun. 2, 2023, mailed Mar. 22, 2024, 9 pgs.
Borst Sr., Kendrick Michael; Notice of Allowance for U.S. Appl. No. 29/749,665, filed Sep. 8, 2020, mailed Mar. 21, 2024, 11 pgs.
Ball, Randy; Notice of Allowance for Design U.S. Appl. No. 29/825,994, filed Feb. 8, 2022, mailed Feb. 26, 2024, 10 pgs.
Borst Sr., Kendrick Michael; Non-Final Office Action for U.S. Appl. No. 18/207,080, filed Jun. 7, 2023, mailed Dec. 15, 2023, 32 pgs.
Borst Sr., Kendrick Michael; Notice of Allowance for U.S. Appl. No. 18/207,080, filed Jun. 7, 2023, mailed Jan. 25, 2024, 5 pgs.
Humberstone, Robert F.; Non-Final Office Action for U.S. Appl. No. 18/205,401, filed Jun. 2, 2023, mailed Dec. 7, 2023, 31 pgs.
Humberstone, Robert F.; Non-Final Office Action for U.S. Appl. No. 18/205,403, filed Jun. 2, 2023, mailed Dec. 7, 2023, 29 pgs.
Borst Sr., Kendrick Michael; Final Office Action for Design U.S. Appl. No. 29/749,665, filed Sep. 8, 2020, mailed Dec. 12, 2023, 15 pgs.
Humberstone, Robert F.; Ex Parte Quayle Action for Design U.S. Appl. No. 29/748,620, filed Aug. 31, 2020, mailed Dec. 19, 2023, 20 pgs.
Borst Sr., Kendrick Michael; Non-Final Office Action for Design U.S. Appl. No. 29/749,665, filed Sep. 8, 2020, mailed Jun. 15, 2023, 53 pgs.
Cardboard Box: Announced [Apr. 20, 2023; online]. Retrieved [Jun. 16, 2023]. URL: https://www.dreamstime.com/royalty=free-stock-image-cardboaard-box-image21861166 (Year: 2013) 1 pg.
Humberstone, Robert F.; Non-Final Office Action for U.S. Appl. No. 29/748,620, filed Aug. 31, 2020, mailed Aug. 11, 2023, 55 pgs.
Pizza Pizza. [Date Not Available; online]. Retrieved [Jun. 16, 2023]. URL: https://markets.businessinsider.com/news/stocks/pizza-pizza-delivers-peace-of-mind-with-new-tamper-proof-pizza-box-1029075812 (Year: 2023), 1 pg.
Versacube: Announced [Oct. 28, 2021; online]. Retrieved [Jun. 16, 2023]. URL: https://www.oberk.com/containers/plastic/plastic-jug/58240009-5gallon-natural-hdpe-versacube-generic-carton-square-38-400-te-neck (Year: 2021), 1 pg.
Humberstone, Robert F.; Notice of Allowance for U.S. Appl. No. 18/205,401, filed Jun. 2, 2023, mailed Aug. 13, 2024, 5 pgs.
Humberstone, Robert F.; Notice of Allowance for U.S. Appl. No. 18/205,403, filed Jun. 2, 2023, mailed Aug. 14, 2024, 5 pgs.
Humberstone, Robert F.; Notice of Allowance for Design U.S. Appl. No. 29/748,620, filed Aug. 31, 2020, mailed Aug. 15, 2024, 5 pgs.
Ball, Randy; Notice of Allowance for Design U.S. Appl. No. 29/825,994, filed Feb. 8, 2022, mailed Sep. 17, 2024, 11 pgs.
Amazon.com; Article entitled: Fairlegend Self Sealing Small Corrugated Cardboard Shipping Boxes Mailers 4x3x2 Mailer Boxes for Small Businesses, posted at Amazon.com on Feb. 5, 2021, Available from internet, URL: <https://www.amazon.com/Cardboard-Mailer-Self-Sealing-Shipping-Tear-Off/dp/B08VN GJ BCG> (Year: 2021), 2 pgs.
Amazon.com; Article entitled: Aviditi Brown Kraft Literature Mailing Boxes, 11 1-8 x 8 3/4 x 4 Inches, Pack of 50, Crush Proof, for Shipping, Mailing, and Storing, posted at Amazon.com on Jul. 22, 2010, 2 pgs.
Ball, Randy; Notice of Allowance for Design U.S. Appl. No. 29/943,344, filed May 21, 2024, mailed Jul. 3, 2024, 8 pgs.
Borst Sr., Kendrick Michael; Certificate of Correction for U.S. Appl. No. 16/915,556, filed Jun. 29, 2020, mailed Dec. 20, 2022, 1 pg.
Borst Jr., Kendrick Michael; Applicant-Initiated Interview Summary for U.S. Appl. No. 17/830,020, filed Jun. 1, 2022, mailed Feb. 21, 2023, 2 pgs.
Humberstone, Robert F.; Notice of Allowance for U.S. Appl. No. 17/001,016, filed Aug. 24, 2020, mailed Mar. 6, 2023, 12 pgs.

(56) References Cited

OTHER PUBLICATIONS

Humberstone, Robert F.; Applicant-Initiated Interview Summary for U.S. Appl. No. 17/001,016, filed Aug. 24, 2020, mailed Jul. 12, 2022, 2 pgs.
Humberstone, Robert F.; Non-Final Office Action for U.S. Appl. No. 17/001,016, filed Aug. 24, 2020, mailed May 6, 2022, 31 pgs.
Borst Sr., Kendrick Michael; Non-Final Office Action for U.S. Appl. No. 17/830,020, filed Jun. 1, 2022, mailed Nov. 28, 2022, 18 pgs.
Humberstone, Robert F.; Final Office Action for U.S. Appl. No. 17/001,016, filed Aug. 24, 2020, mailed Nov. 15, 2022, 14 pgs.
Borst Sr., Kendrick Michael; Applicant-Initiated Interview Summary for Design U.S. Appl. No. 29/749,665, filed Sep. 8, 2020, mailed Sep. 28, 2023, 3 pgs.
Avi Diti Mailer Box, posted at Amazon.com on Jul. 22, 2010, [site visited Sep. 7, 2023]. Available from internet, URL: <https://www.amazon.com/dp/BOOBT5L TTG/> (Year: 2010), 1 pg.
Ball, Randy; Non-Final Office Action for Design U.S. Appl. No. 29/825,994, filed Feb. 8, 2022, mailed Oct. 6, 2023, 45 pgs.
Borst Sr., Kendrick Michael; Certificate of Correction for U.S. Appl. No. 17/830,020, filed Jun. 1, 2022, mailed Oct. 15, 2024, 5 pgs.
Borst Sr., Kendrick Michael; Certificate of Correction for U.S. Appl. No. 18/207,080, filed Jun. 7, 2023, mailed Dec. 3, 2024, 1 pg.
Borst Sr., Kendrick Michael; Ex Parte Quayle Action for Design U.S. Appl. No. 29/947,936, filed Jun. 18, 2024, mailed Sep. 30, 2024, 29 pgs.
Boxes Fast Corrugated Cardboard Mailers, posted at Amazon.com on Dec. 12, 2017, [site visited Sep. 7, 2024]. Available from internet, URL: <https://www.amazon.com/Boxes-Fast-BFM LRCD-Corrugated-Cardboard/dp/B0786LQMYL/> (Year: 2017), 2 pgs.
Ireer Pizza Box, posted at Amazon.com on Aug. 16, 2023, [site visited Sep. 7, 2024]. Available from internet, URL: <https://www.amazon.com/Ireer-Corrugated-Cardboard-Takeaway-Shipping/dp/BOCFTPTLWB/> (Year: 2023), 2 pgs.
Humberstone, Robert F.; Non-Final Office Action for U.S. Appl. No. 18/967,391, filed Dec. 3, 2024, mailed Feb. 21, 2025, 32 pgs.
Borst Sr., Kendrick Michael; Notice of Allowance for Design U.S. Appl. No. 29/947,936, filed Jun. 18, 2024, mailed Feb. 12, 2025, 12 pgs.
Humberstone, Robert F.; Certificate of Correction for U.S. Appl. No. 17/001,016, filed Aug. 24, 2020, mailed May 13, 2025, 1 pg.
Humberstone, Robert F.; Notice of Allowance for U.S. Appl. No. 18/967,391, filed Dec. 3, 2024, mailed Apr. 4, 2025, 5 pgs.
Ball, Randy; Notice of Allowance for Design U.S. Appl. No. 29/967,735, filed Oct. 11, 2024, mailed Apr. 2, 2025, 38 pgs.
Light Rain Self-adhesive Zipper Carton Box, posted at Amazon.com on Feb. 24, 2023, [site visited Feb. 21, 2025]. Available from internet, URL: < https://www.amazon.com/LIGHT-RAIN-Self-adhesive-Zipper-Business/dp/BOBWRJRLNL> (Year: 2023).
Tear-Off Rectangular Soap Boxes, posted at uxboxes.com (date not available), [site visited Feb. 20, 2025]. Available from internet, URL: <https://uxboxes.com/product/rectangular-box/> (Year: NA) (Year: NA).
APG Tatents Tamper Evident System: Announced (Nov. 9, 2020; online). Site Visited (Jun. 26, 2025). Available from URL: https://www.albertinipackaging.com/en/apg-patents-tamper-evident-system/.
Custom Pizza Box: Announced (Jun. 26, 2023; online). Site Visited (Jun. 26, 2025). Available from URL: https://www.pratt.com/product/custom-pizza-box.
Humberstone, Robert F.; Non-Final Office Action for Design U.S. Appl. No. 29/983,574, filed Jan. 10, 2025, mailed Jun. 30, 2025, 20 pgs.
Lock Box Tamper Evident Pizza Boxes: Announced (Nov. 25, 2020; online). Site Visited (Jun. 26, 2025). Available from URL: ttps://www.pizzaboxes.com.au/lock-box.php.
Sustainable Pizza Box Packaging: Announced (Jun. 26, 2023). Site Visited (Jun. 26, 2025). Available from URL: https://qsrmedia.asia/design/news/canadian-2-1-pizza-adopts-trias-sustainable-pizza-box-packaging.

* cited by examiner

SHOEBOX

TECHNICAL FIELD

This disclosure relates to boxes. More specifically, this disclosure relates to a shoebox that can be secured in a closed configuration.

BACKGROUND

Shoeboxes are commonly used to store shoes. Typical shoeboxes comprise a lid that can be selectively opened and closed, but that cannot be secured in the closed position. Therefore, contents (e.g., shoes) within the shoebox are not securely contained. Furthermore, shoeboxes are often shipped inside of a second box that can be secured in order to prevent damage or loss of the shoes during transport, such as by theft. Requiring a second box for shipping increases both material waste and the cost of shipping the shoes.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is shoebox comprising a first main panel; a second main panel opposite the first main panel; a first connecting panel extending from the first main panel, the first connecting panel defining a locking slot; a second connecting panel extending between the first main panel and the second main panel opposite the first connecting panel; an overlapping panel extending from the second main panel and at least partially overlapping the first connecting panel; and a locking tab extending from the overlapping panel, the locking tab in locking engagement with the locking slot in a closed and locked configuration of the shoebox.

Also disclosed is a shoebox blank comprising a first main panel defining a first end and a second end opposite the first end; a second main panel defining a first end and a second end opposite the first end; a first connecting panel extending from and hingedly connected to the first end of the first main panel, the first connecting panel defining a locking slot; a second connecting panel extending between and hingedly connected to each of the second end of the first main panel and the second end of the second main panel; an overlapping panel extending from and hingedly connected to the first end of the second main panel; and a locking tab extending from the overlapping panel.

Also disclosed is a method of securing a shoebox in a closed and locked configuration comprising providing a shoebox in an open and unlocked configuration, the shoebox defining an interior and a shoebox opening allowing access to the interior; folding a main panel of the shoebox over the shoebox opening to prohibit access to the interior; folding an overlapping panel of the shoebox over a connecting panel of the shoebox, the connecting panel defining a locking slot; inserting a locking tab of the shoebox into the locking slot to secure the shoebox in the closed and locked configuration, the locking tab extending from the overlapping panel.

Additionally, disclosed is a method of opening a shoebox comprising providing the shoebox in a closed and locked configuration, wherein the shoebox comprises a shoebox body including a tearaway portion, the tearaway portion comprising a locking tab and a tear strip, the locking tab in locking engagement with a locking slot of the shoebox; detaching the tearaway portion from the shoebox body, wherein detaching the tearaway portion from the shoebox body comprises: pulling the tear strip away from a surrounding panel body of the shoebox; and ripping a tear line defining the tear strip; and unfolding a main panel of the shoebox to uncover a shoebox opening allowing access to an interior of the shoebox.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
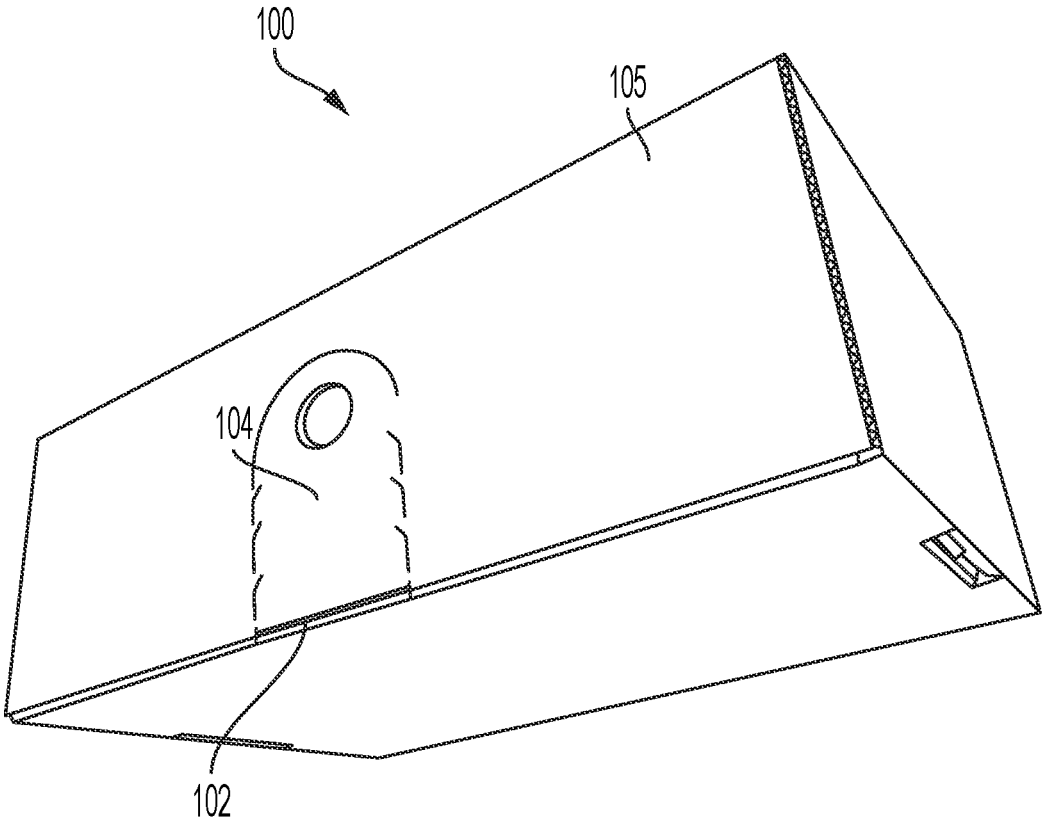
FIG. 1 is a bottom perspective view of a shoebox secured in a closed and locked configuration, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a shoebox and associated methods, systems, devices, and various apparatus. Example aspects of the shoebox can comprise a locking slot and a locking tab configured to engage the locking slot to secure the shoebox in a locked configuration. It would be understood by one of skill in the art that the shoebox is described in but a few exemplary embodiments among many. No particular terminology or description should be considered limiting on the disclosure or the scope of any claims issuing therefrom.

FIG. 1 is a bottom perspective view of a box 100, in accordance with one aspect of the present disclosure. The box 100 is shown in a closed and locked configuration, wherein contents within an interior 605 (shown in FIG. 6) of the box 100 can be secured therein and cannot be accessed or removed without damaging the box 100. In the present aspect, the box 100 can be a shoebox 100 configured to receive shoes within the interior 605 thereof. In other aspects, however, the box 100 can be configured to house any other suitable contents therein. In example aspects, the shoebox 100, or portions thereof, can comprise a cardboard material. For example, the shoebox 100, or portions thereof, can comprise a corrugated paper or corrugated plastic cardboard material. In the present aspect, the shoebox 100 can comprise a corrugated paper material. In other aspects, however, the shoebox 100 can comprise any other suitable material or combination of materials known in the art and may or may not be corrugated. According to example aspects, the shoebox 100 can define a locking slot 102 and a locking tab 238 (shown in FIG. 2) configured to engage the locking slot 102 to secure the shoebox 100 in the locked and closed configuration. The locking tab 238 can form part of a tearaway portion 104 of the shoebox 100, which can be torn away from a body 105 of the shoebox 100 to unlock the shoebox 100 and allow the shoebox 100 to be opened. In example aspects, the shoebox 100 can be formed from a shoebox blank 200, as shown in FIG. 2 and described in detail below.

Figure 2:
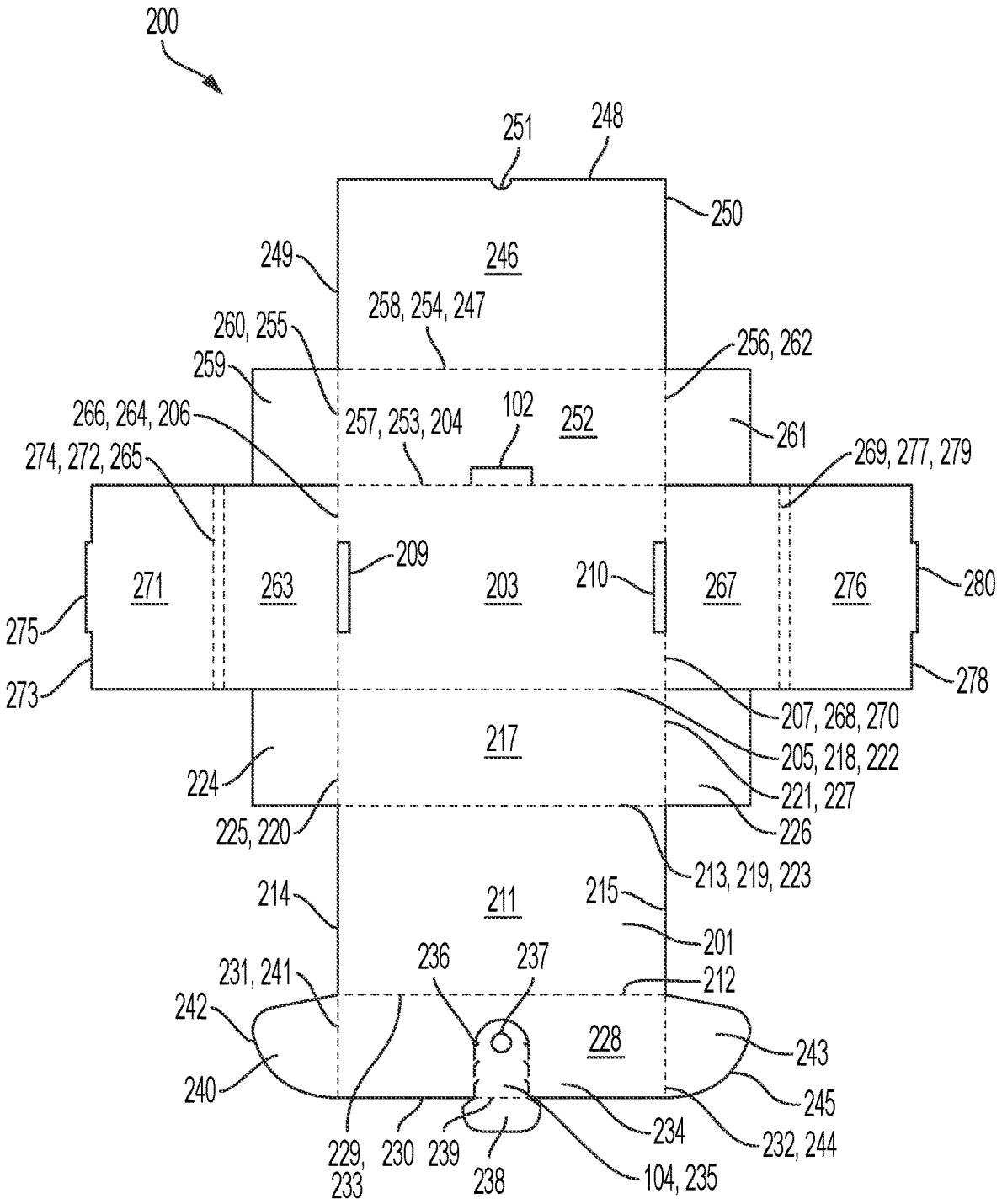
FIG. 2 is a top plan view of a shoebox blank, wherein the shoebox blank is foldable to form the shoebox of FIG. 1.

FIG. 2 illustrates a top plan view of the shoebox blank 200, in accordance with an aspect of the present disclosure. In example aspects, the shoebox blank 200 can be monolithically formed (i.e., formed a singular component that constitutes a single material without joints or seams). The shoebox blank 200 can be foldable to define the shoebox 100 of FIG. 1. As shown, the shoebox blank 200 can be substantially planar. Example aspects of the shoebox blank 200 can define an inner surface 201 and an outer surface 302 (shown in FIG. 3). The shoebox blank 200 can comprise a plurality of panels that can together define the body 105 (shown in FIG. 1) of the shoebox 100. For example, the shoebox blank 200 can define a first main panel, such as a lower main panel 203, and a second main panel, such as an upper main panel 211. The lower main panel 203 and the upper main panel 211 can be about equal in size and shape. In the present aspect, each of the lower main panel 203 and the upper main panel 211 can be substantially rectangular in shape, as shown. In other aspects, the lower and upper main panels 203,211 may differ in size and/or shape, and can define any suitable shape known in the art, including polygonal shapes, rounded shapes, and complex shapes.

According to example aspects, the lower main panel 203 can define a lower front end 204, a lower rear end 205 opposite the lower front end 204, a lower first side end 206, and a lower second side end 207 opposite the lower first side end 206. Each of the lower first side end 206 and the lower second side end 207 can extend between the lower front end 204 and the lower rear end 205. Adjacent ones of the lower front end 204, lower rear end 205, lower first side end 206, and lower second side end 207 can intersect one another, as shown. Similarly, the upper main panel 211 can define an upper front end 212, an upper rear end 213 opposite the upper front end 212, an upper first side end 214, and an upper second side end 215 opposite the upper first side end 214. Each of the upper first side end 214 and the upper second side end 215 can extend between the upper front end 212 and the upper rear end 213. Adjacent ones of the upper front end 212, upper rear end 213, upper first side end 214, and upper second side end 215 can intersect one another.

A first connecting panel, such as a rear connecting panel 217, can extend from the lower main panel 203 to the upper main panel 211 to connect the lower and upper main panels 203,211 together. Specifically, the rear connecting panel 217 can extend between the lower rear end 205 of the lower main panel 203 and the upper rear end 213 of the upper main panel 211, as shown. The rear connecting panel 217 can define a connecting lower end 218, a connecting upper end 219 opposite the connecting lower end 218, a connecting first side end 220, and a connecting second side end 221 opposite the connecting first side end 220. Each of the connecting first side end 220 and the connecting second side end 221 can extend between the connecting lower end 218 and the connecting upper end 219. According to example aspects, the connecting lower end 218 can be hingedly connected to the lower rear end 205 at a lower rear connecting bend line 222 and the connecting upper end 219 can be hingedly connected to the upper rear end 213 at an upper rear connecting bend line 223. Furthermore, a first rear connecting flap 224 can extend from the connecting first side end 220 and can be hingedly connected thereto by a first rear flap bend line 225, and a second rear connecting flap 226 can extend from the connecting second side end 221 and can be hingedly connected thereto by a second rear flap bend line 227.

Example aspects of the shoebox blank 200 can further comprise an overlapping panel, such as an overlapping front panel 228, extending from the upper main panel 211, distal to the rear connecting panel 217. The front panel 228 can define a front upper end 229, a front lower end 230 opposite the front upper end 229, a front first side end 231, and a front second side end 232 opposite the front first side end 231. Each of the front first side end 231 and the front second side end 232 can extend between the front upper and the front lower end 230. As shown, the front upper end 229 of the front panel 228 can be hingedly connected to the upper front end 212 of the upper main panel 211 at a front bend line 233. In example aspects, the front panel 228 can at least partially define the tearaway portion 104. The tear strip 235 can be formed with the front panel 228, and the front panel 228 can further define a front panel body 234 surrounding the tear strip 235. In example aspects, the tear strip 235 can be defined by a tear line 236 extending into the front panel 228 from the front lower end 230. The tear strip 235 is described in further detail below. In some aspects, an engagement opening 237 can be formed through the tear strip 235. The locking tab 238 can extend away from the front panel 228 at the front lower end 230, as shown. According to example aspects, the locking tab 238 can be hingedly connecting to the tear strip 235 at the front lower end 230 by a tab bend line 239.

In the present aspect, the shoebox blank 200 can comprise a first closure flap 240 extending from the front first side end 231 of the front panel 228 and a second closure flap 243 extending from the front second side end 232 of the front panel 228. The first closure flap 240 can be hingedly connected to the front first side end 231 by a first side bend line 241, and the second closure flap 243 can be hingedly connected to the front second side end 232 by a second side bend line 244. The first closure flap 240 can define a first outer side end 242 generally opposite the first side bend line 241, and the second closure flap 243 can define a second outer side end 245 generally opposite the second side bend line 244. In some example aspects, each of the first outer side end 242 and the second outer side end 245 can be curved to facilitate engagement of the first and second outer side ends 242,245 with corresponding first and second closure slots 810,910 (shown in FIGS. 8 and 9, respectively) of the shoebox 100, as described in further detail below.

According to example aspects, the shoebox blank 200 can further comprise a secondary panel, such as a secondary upper panel 246. The secondary upper panel 246 can define a secondary front end 247, a secondary rear end 248 opposite the secondary front end 247, a secondary first side end 249, and a secondary second side end 250 opposite the upper first side end 214. Each of the secondary first side end 249 and the secondary second side end 250 can extend between the secondary front end 247 and the secondary rear end 248. In some aspects, the secondary upper panel 246 can define an engagement notch 251 at the secondary rear end 248. A second connecting panel, such as a front connecting panel 252, can extend from the lower main panel 203 to the secondary upper panel 246 to connect the lower main panel 203 and the secondary upper panel 246 together. Specifically, the front connecting panel 252 can extend between the lower front end 204 of the lower main panel 203 and the upper front end 212 of the secondary upper panel 246, as shown. The front connecting panel 252 can define a connecting lower end 253, a connecting upper end 254 opposite the connecting lower end 253, a connecting first side end 255, and a connecting second side end 256 opposite the connecting first side end 255. Each of the connecting first side end 255 and the connecting second side end 256 can extend between the connecting lower end 253 and the connecting upper end 254. Other aspects of the shoebox blank 200 may not comprise the secondary upper panel 246.

According to example aspects, the connecting lower end 253 of the front connecting panel 252 can be hingedly connected to the lower front end 204 of the lower main panel 203 at a lower front connecting bend line 257. The connecting upper end 254 of the front connecting panel 252 can be hingedly connected to the secondary front end 247 of the secondary upper panel 246 at an upper front connecting bend line 258. The locking slot 102 can be defined through the front connecting panel 252 substantially at or near the lower front connecting bend line 257. The locking slot 102 can be configured to receive the locking tab 238 therethrough in the closed and locked configuration of the shoebox 100. Furthermore, a first front connecting flap 259 can extend from the connecting first side end 255 and can be hingedly connected thereto by a first front flap bend line 260, and a second front connecting flap 261 can extend from the connecting second side end 256 and can be hingedly connected thereto by a second front flap bend line 262.

According to example aspects, the lower main panel 203 can define a first engagement slot 209 at the lower first side end 206 thereof and a second engagement slot 210 at the lower second side end 207 thereof. Furthermore, the shoebox blank 200 can comprise a first inner side panel 263 extending from the lower first side end 206 and a second inner side panel 267 extending from the lower second side end 207. The first inner side panel 263 can define a first inner end 264 and a first outer end 265 opposite the first inner end 264, and the first inner end 264 can be hingedly connected to the lower first side end 206 by a first inner bend line 266. The second inner side panel 267 can define a second inner end 268 and a second outer end 269 opposite the second inner end 268, and the second inner end 268 can be hingedly connected to the lower second side end 207 by a second inner bend line 270.

The shoebox blank 200 can further comprise a first outer side panel 271 extending from the first inner side panel 263 and a second outer side panel 276 extending from the second inner side panel 267. The first outer side panel 271 can define a first inner end 272 and a first outer end 273 opposite the first inner end 272, and the first inner end 272 can be hingedly connected to the first outer end 265 of the first inner side panel 263 by a first outer bend line 274, which can be defined by a pair of parallel bend line segments, as described further below. Similarly, the second outer side panel 276 can define a second inner end 277 and a second outer end 278 opposite the second inner end 277, and the second inner end 277 can be hingedly connected to the second outer end 269 of the second inner side panel 267 by a second outer bend line 279, which can be defined by a pair of parallel bend line segments, as described further below. A first engagement tab 275 can extend from the first outer end 273 of the first outer side panel 271, and a second engagement tab 280 can extend from the second outer end 278 of the second outer side panel 276. The first engagement tab 275 can be configured to engage the first engagement slot 209 of the lower main panel 203 and the second engagement tab 280 can be configured to engage the second engagement slot 210 of the lower main panel 203 when the shoebox 100 of FIG. 1 is assembled.

Figure 3:
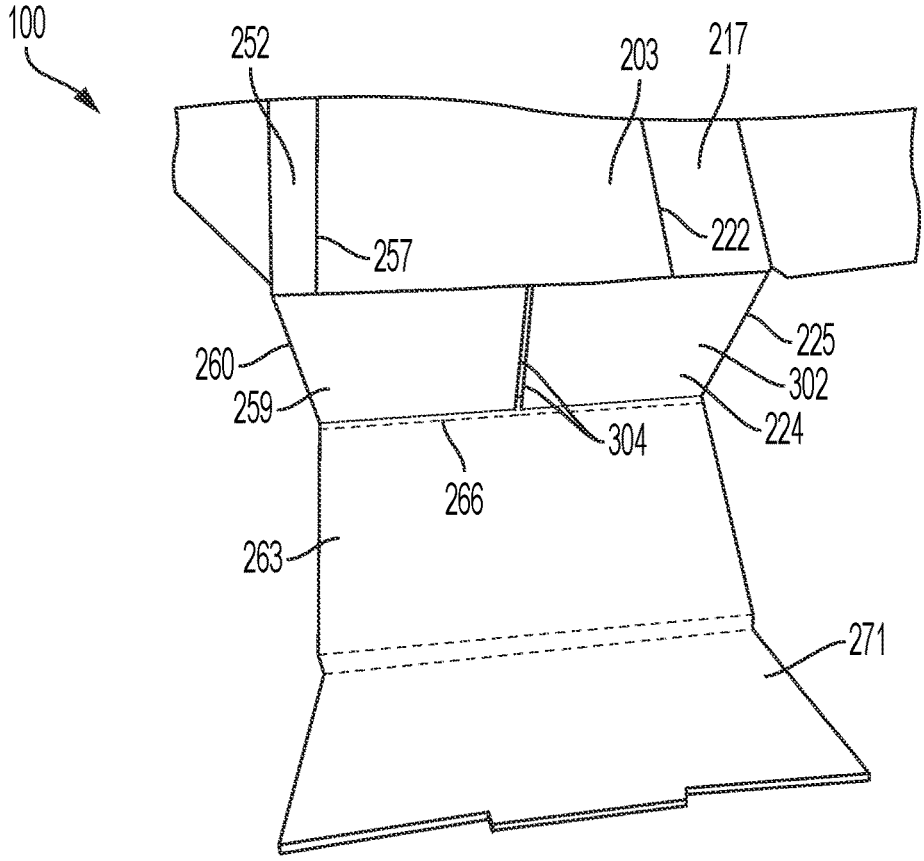
FIG. 3 is a perspective view illustrating a first step in folding the shoebox blank of FIG. 2 to form the shoebox of FIG. 1.

FIG. 3 illustrates a first step in folding the shoebox blank 200 (shown in FIG. 2) to form the shoebox 100. Each of the rear connecting panel 217 and the front connecting panel 252 can be folded inward relative to the lower main panel 203 at the corresponding lower rear connecting bend line 222 and lower front connecting bend line 257, respectively. When folded inward, each of the rear connecting panel 217 and the front connecting panel 252 can be oriented about perpendicular to the lower main panel 203 and about parallel with one another.

Furthermore, the first rear connecting flap 224 can be folded inward relative to the rear connecting panel 217 at the first rear flap bend line 225. Similarly, the first front connecting flap 259 can be folded inward relative to the front connecting panel 252 at the first front flap bend line 260. The first rear connecting flap 224 and the first front connecting flap 259 can be oriented substantially planar with one another, and can be oriented about perpendicular to each of the lower main panel 203, the rear connecting panel 217, and the front connecting panel 252. In example aspects, the first rear connecting flap 224 and the first front connecting flap 259 can be sized such that distal flap ends 304 thereof, distal to the corresponding rear and front connecting panels 217, 252, can substantially confront one another. In other aspects, the distal flap ends 304 of the first rear connecting flap 224 and the first front connecting flap 259 can be spaced from one another or can overlap one another. Each of the second rear connecting flap 226 (shown in FIG. 2) and the second front connecting flap 261 (shown in FIG. 2) can be folded inward in substantially the same manner.

The first inner side panel 263 can then be folded inward towards the first rear connecting flap 224 and the first front connecting flap 259 at the corresponding first inner bend line 266. Once folded, the first inner side panel 263 can confront and lie substantially parallel to the first rear connecting flap 224 and the first front connecting flap 259. Furthermore, once folded, the first inner side panel 263 can extend substantially between the rear connecting panel 217 and the front connecting panel 252, and can be oriented about perpendicular to each of the lower main panel 203, the rear connecting panel 217, and the front connecting panel 252. The second inner side panel 267 (shown in FIG. 2) can be folded inward towards the second rear connecting flap 226 (shown in FIG. 2) and the second front connecting flap 261 (shown in FIG. 2) in substantially the same manner.

Figure 4:
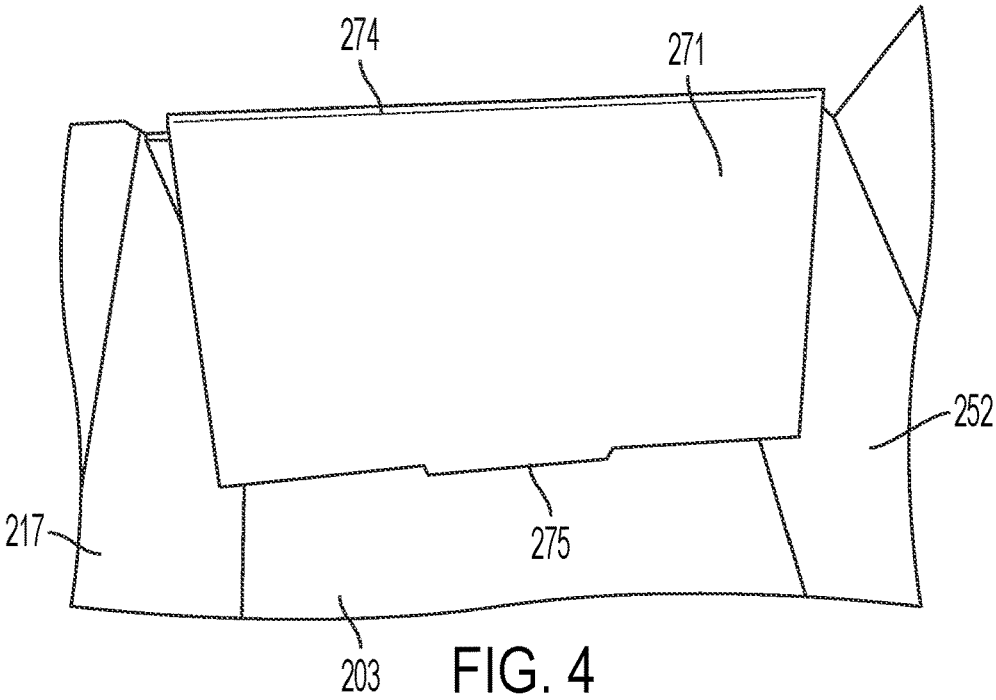
FIG. 4 is a perspective view illustrating a second step in folding the shoebox blank of FIG. 2 to form the shoebox of FIG. 1.

FIG. 4 illustrates a next step in folding the shoebox blank 200 (shown in FIG. 2) to form the shoebox 100. As shown, the first outer side panel 271 can be folded inward over each of the first rear connecting flap 224 (shown in FIG. 2) and the first front connecting flap 259 (shown in FIG. 2), relative to the first inner side panel 263 (shown in FIG. 2), at the corresponding first outer bend line 274. The first outer side panel 271 can be oriented substantially parallel to each of the first rear connecting flap 224, the first front connecting flap 259, and the first inner side panel 263, such that the first rear connecting flap 224 and the first front connecting flap 259 can be sandwiched between the first inner side panel 263 and the first outer side panel 271. The first outer side panel 271 can further extend between the rear connecting panel 217 and the front connecting panel 252, and can be oriented about perpendicular to each of the lower main panel 203, the rear connecting panel 217, and the front connecting panel 252. Furthermore, the first engagement tab 275 can be disposed adjacent to the lower main panel 203. The second outer side panel 276 (shown in FIG. 2) can be folded inward over the second rear connecting flap 226 (shown in FIG. 2) and the second front connecting flap 261 (shown in FIG. 2) in substantially the same manner.

Figure 5:
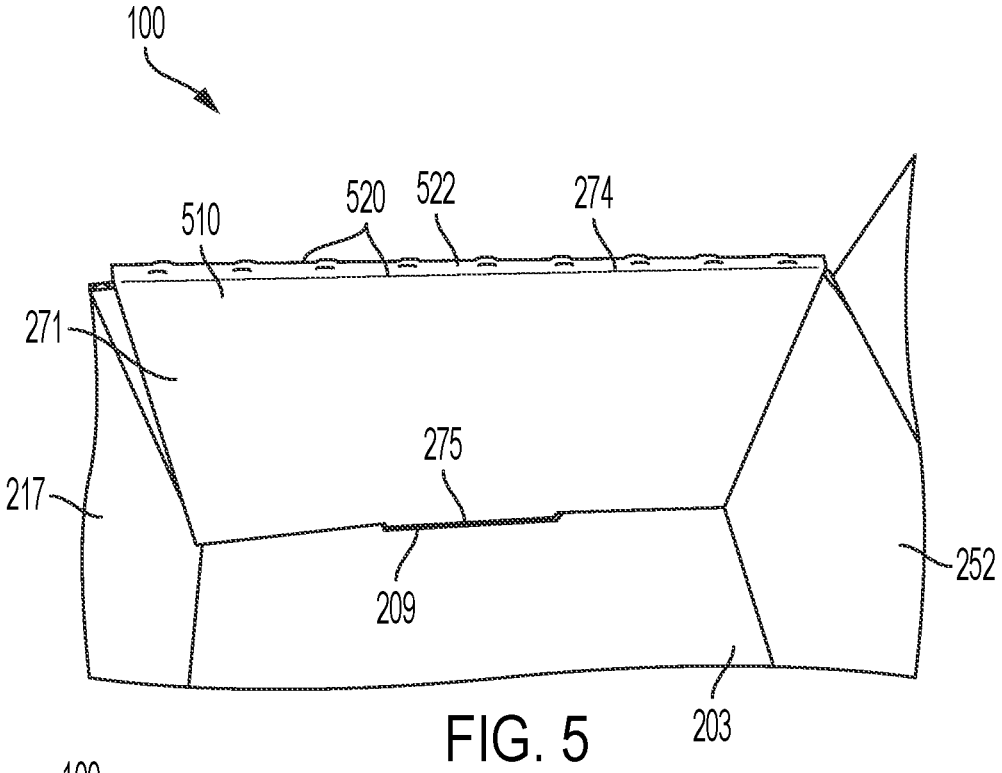
FIG. 5 is a perspective view illustrating a third step in folding the shoebox blank of FIG. 2 to form the shoebox of FIG. 1.

Referring to FIG. 5, in example aspects, the first outer bend line 274 can comprise the pair of parallel outer bend line segments 520 and a narrow bend line panel 522 therebetween, which can facilitate folding the first outer side panel 271 relative to the first inner side panel 263 (shown in FIG. 2). More explicitly, the outer bend line segments 520 and the bend line panel 522 can allow the first outer side panel 271 to fold about 180° relative to the first inner side panel 263 with the first rear connecting flap 224 (shown in FIG. 2) and the first front connecting flap 259 (shown in FIG. 2) disposed therebetween, without creasing or other deforming either of the first inner side panel 263 or the first outer side panel 271. The second outer bend line 279 can be similarly formed to comprise a pair of the outer bend line segments 520 and the narrow bend line panel 522 therebetween. As shown, to secure the first outer side panel 271 in position, the first engagement tab 275 thereof can engage the first engagement slot 209 formed in the lower main panel 203. The first outer side panel 271, the first inner side panel 263, the first rear connecting flap 224, and the first front connecting flap 259 can together define a first side wall 510 of the shoebox 100.

Figure 6:
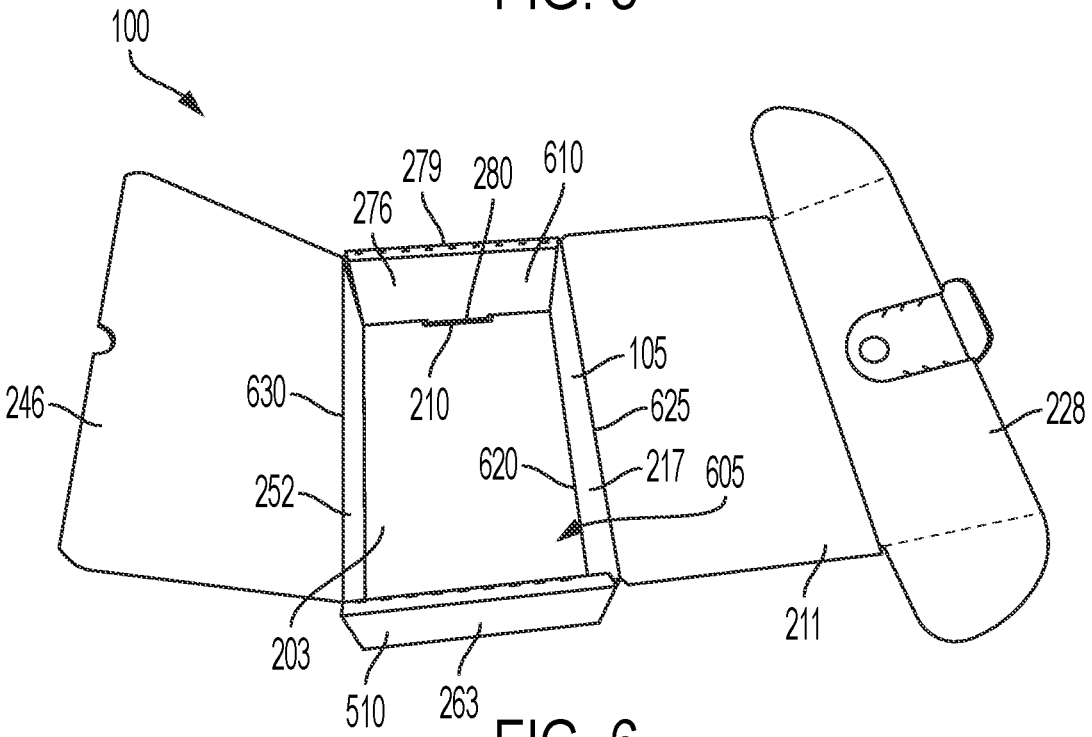
FIG. 6 is a perspective view illustrating a fourth and final step in folding the shoebox blank of FIG. 2 to form the shoebox of FIG. 1, wherein the shoebox is shown in an open and unlocked configuration.

As shown in FIG. 6, the second outer side panel 276 can similarly be folded at the corresponding second outer bend line 279 and secured in position by engaging the second engagement tab 280 thereof with the second engagement slot 210 formed in the lower main panel 203. The second outer side panel 276, the second inner side panel 267 (shown in FIG. 2), the second rear connecting flap 226 (shown in FIG. 2), and the second front connecting flap 261 (shown in FIG. 2) can together define a second side wall 610 of the shoebox 100.

FIG. 6 illustrates the assembled shoebox 100 in an open and unlocked configuration. The body 105 of the shoebox 100 can define a bottom shoebox end 620 and a top shoebox end 625. As shown, the lower main panel 203, the rear connecting panel 217, the front connecting panel 252, the first side wall 510, and the second side wall 610 can at least partially define the interior 605 of the shoebox 100. The lower main panel 203 can be disposed at the bottom shoebox end 620, and a shoebox opening 630 can be defined at the top shoebox end 625. The shoebox opening 630 can allow access to the interior 605 of the shoebox 100 in the open and unlocked configuration, such as for inserting contents into or removing contents from the interior 605. As described in further detail below, each of the upper main panel 211 and the secondary upper panel 246 can be folded inward to cover the shoebox opening 630 and to configure the shoebox 100 in the closed configuration.

Figure 7:
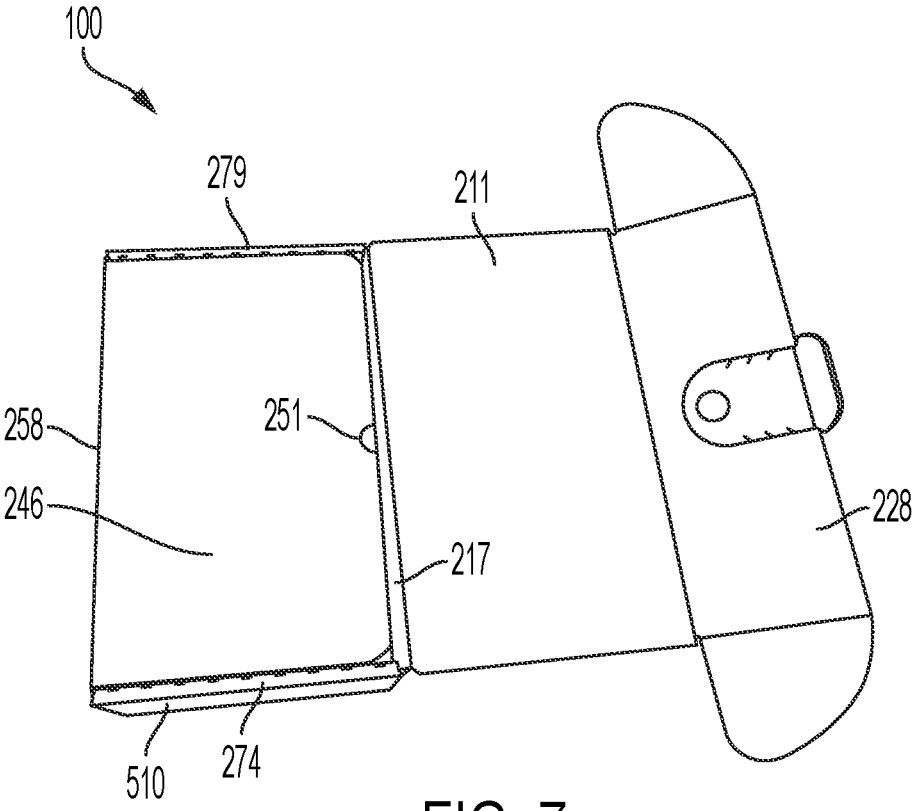
FIG. 7 is a top view illustrating a first step in securing the shoebox of FIG. 1 in the closed and locked configuration.

FIG. 7 illustrates a first step in reconfiguring the shoebox 100 from the open and unlocked configuration to the closed and locked configuration. As shown, the secondary upper panel 246 can be folded inward, relative to the front connecting panel 252 (shown in FIG. 2), towards the interior 605 (shown in FIG. 6) of the shoebox 100 at the corresponding upper front connecting bend line 258. The secondary upper panel 246 can be oriented about parallel to the lower main panel 203 (shown in FIG. 2) and about perpendicular to the front connecting panel 252, and can extend between the first outer bend line 274 and the second outer bend line 279. The shoebox opening 630 (shown in FIG. 6) can be substantially covered by the secondary upper panel 246 to prohibit access to the interior 605 of the shoebox 100 in the closed configuration. The engagement notch 251 of the secondary upper panel 246 can be disposed proximate to the rear connecting panel 217. In example aspects, a user can manually engage the engagement notch 251, such as by inserting a finger or fingers therethrough, to facilitate folding the secondary upper panel 246 away from the interior 605 to open the shoebox 100.

Figure 8:
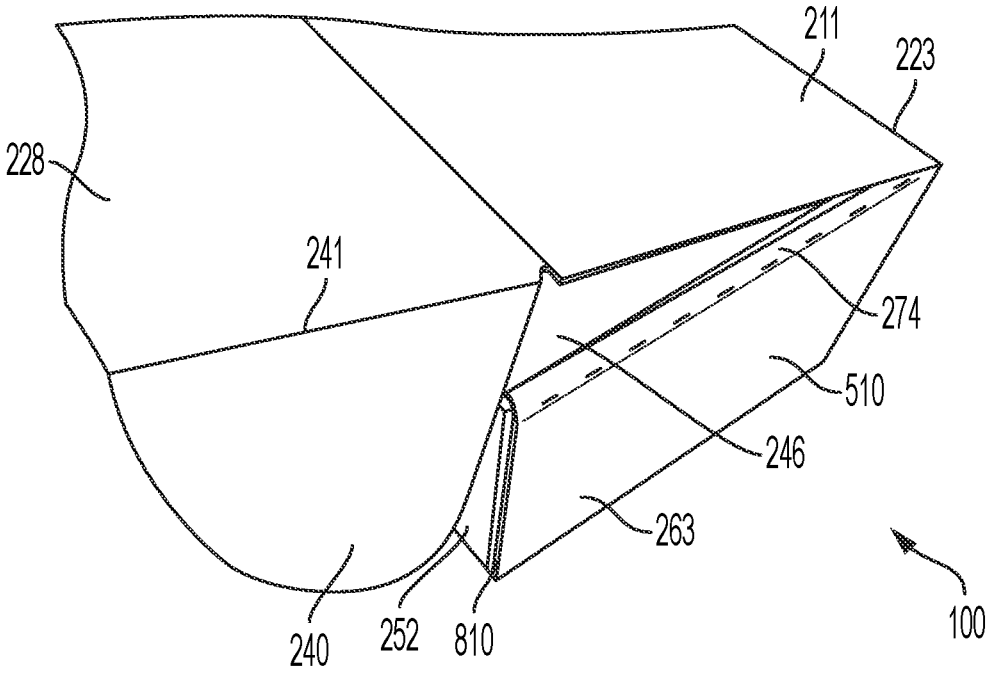
FIG. 8 is a top perspective view illustrating a second step in securing the shoebox of FIG. 1 in the closed and locked configuration.

FIG. 8 illustrates a next step in folding the shoebox 100 to the closed configuration. The upper main panel 211 can be folded inward, relative to the rear connecting panel 217 (shown in FIG. 2), towards the secondary upper panel 246 at the corresponding upper rear connecting bend line 223. The upper main panel 211 can cover, and in some aspects can rest on, the secondary upper panel 246 and can be oriented about parallel to the each of the secondary upper panel 246 and the lower main panel 203 (shown in FIG. 2). In some aspects, the upper main panel 211 can also cover, and in some aspects can rest on, each of the first outer bend line 274 and the second outer bend line 279 (shown in FIG. 2). Furthermore, the secondary upper panel 246 can be oriented about perpendicular to the rear connecting panel 217. Thus, the shoebox opening 630 (shown in FIG. 6) can further be covered by the upper main panel 211 to prohibit access to the interior 605 (shown in FIG. 6) of the shoebox 100 in the closed configuration.

According to example aspects, the first side wall 510 can define the first closure slot 810 between the first inner side panel 263 and the first front connecting flap 259 (shown in FIG. 2). Similarly, the second side wall 610 (shown in FIG. 6) can define the second closure slot 910 (shown in FIG. 9) between the second inner side panel 267 (shown in FIG. 2) and the second front connecting flap 261 (shown in FIG. 2). As shown, the front panel 228 of the shoebox 100 can extend forward beyond the front connecting panel 252. The first closure flap 240 can be folded inward relative to the front panel 228 at the corresponding first side bend line 241. The first closure flap 240 can be oriented substantially perpendicular to the front panel 228, and can be laterally aligned and substantially coplanar with the first closure slot 810. The second closure flap 243 (shown in FIG. 2) can be folded inward relative to the front panel 228 at the corresponding second side bend line 244 (shown in FIG. 2) in substantially the same manner and can be aligned with the second closure slot 910.

Figure 9:
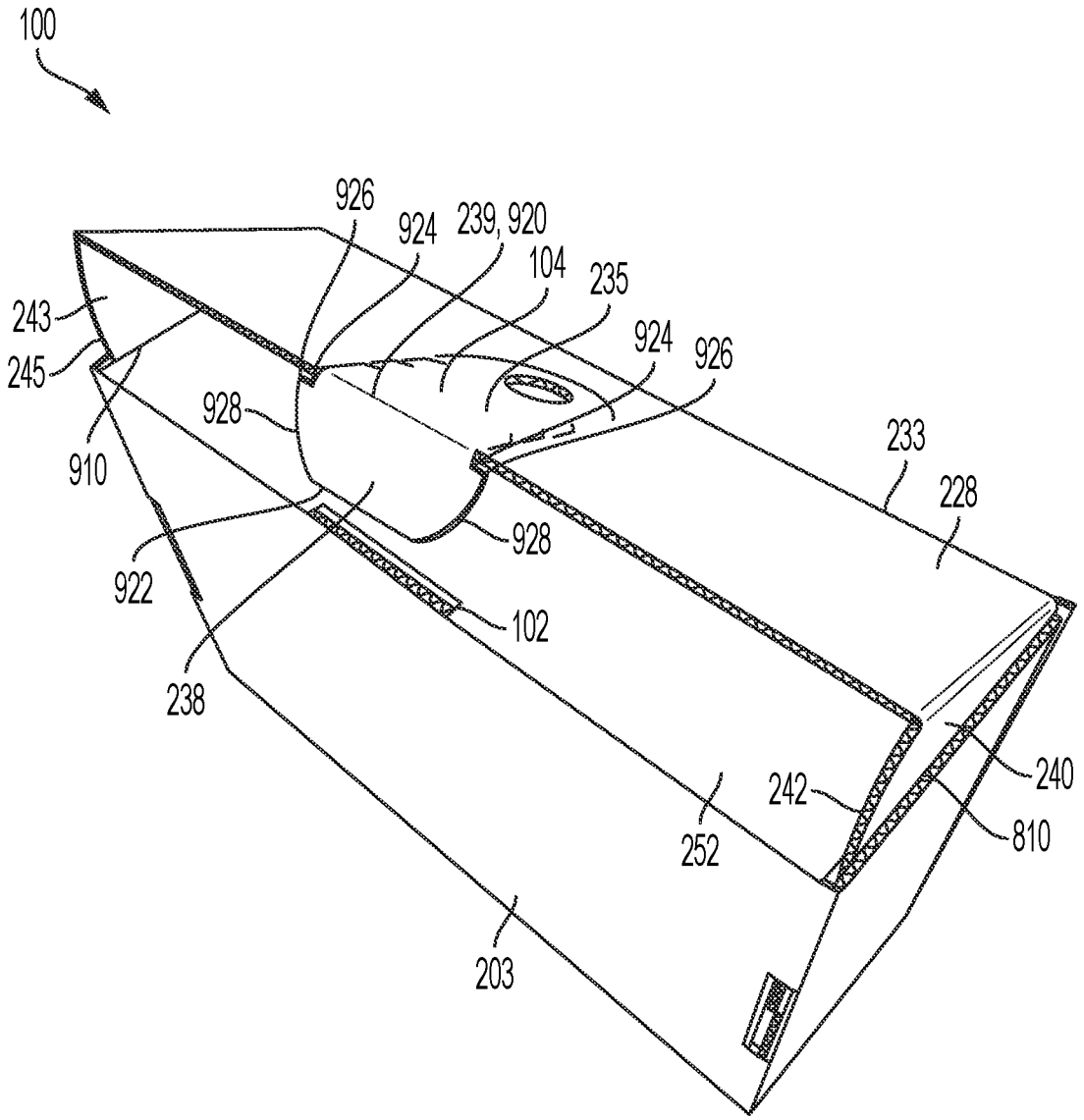
FIG. 9 is a bottom perspective view illustrating a third step in securing the shoebox of FIG. 1 in the closed and locked configuration.

As shown in FIG. 9, the front panel 228 can be folded inward relative to the upper main panel 211 at the corresponding front bend line 233. As the front panel 228 is folded inward, the first closure flap 240 can engage the first closure slot 810 and the second closure flap 243 can engage the second closure slot 910. As described above, in some aspects, the first and second outer side ends 242,245 of the first and second closure flaps 240,243, respectively, can be curved to facilitate sliding the first and second closure flaps 240,243 into the corresponding first and second closure slots 810,910. Furthermore, the locking tab 238 of the tearaway portion 104 can be folded inward relative to the tear strip 235 at the tab bend line 239. When folded, the locking tab 238 can be oriented about perpendicular to the tear strip 235. As the front panel 228 is folded inward, the locking tab 238 can come into lateral alignment with the locking slot 102 formed through the front connecting panel 252. The front panel 228 can be folded to at least partially overlap and to lie substantially flat against the front connecting panel 252. In this configuration, the front panel 228 can extend between and can be oriented substantially perpendicular to each of the lower main panel 203 and the upper main panel 211 (shown in FIG. 2). The first and second closure flaps 240,243 can be fully inserted into the corresponding first and second closure slots 810,910, and the locking tab 238 can be fully inserted through the locking slot 102.

In example aspects, the locking tab 238 define a first tab end 920 at the tab bend line 239 and a second tab end 922 distal to the first tab end 920. A pair of opposing tab notches 924 can be formed at or near the tab bend line 239, such that a tab width of the locking tab 238 can be reduced at the tab notches 924. A pair of opposing locking shoulders 926 can be defined by the corresponding tab notches 924, and opposing tab edges 928 can extend between the corresponding locking shoulders 926 and the second tab end 922. As shown, the tab width of the locking tab 238 at the locking shoulders 926 can be greater than the tab width of the locking tab 238 at the tab notches 924. Moreover, in some aspects, the tab width of the locking tab 238 can taper generally from the locking shoulders 926 towards the second tab end 922 to facilitate inserting the second tab end 922 through the locking slot 102. In some aspects, the opposing tab edges 928 can be curved, as shown, to further facilitate inserting the locking tab 238 through the locking slot 102.

Figure 10:
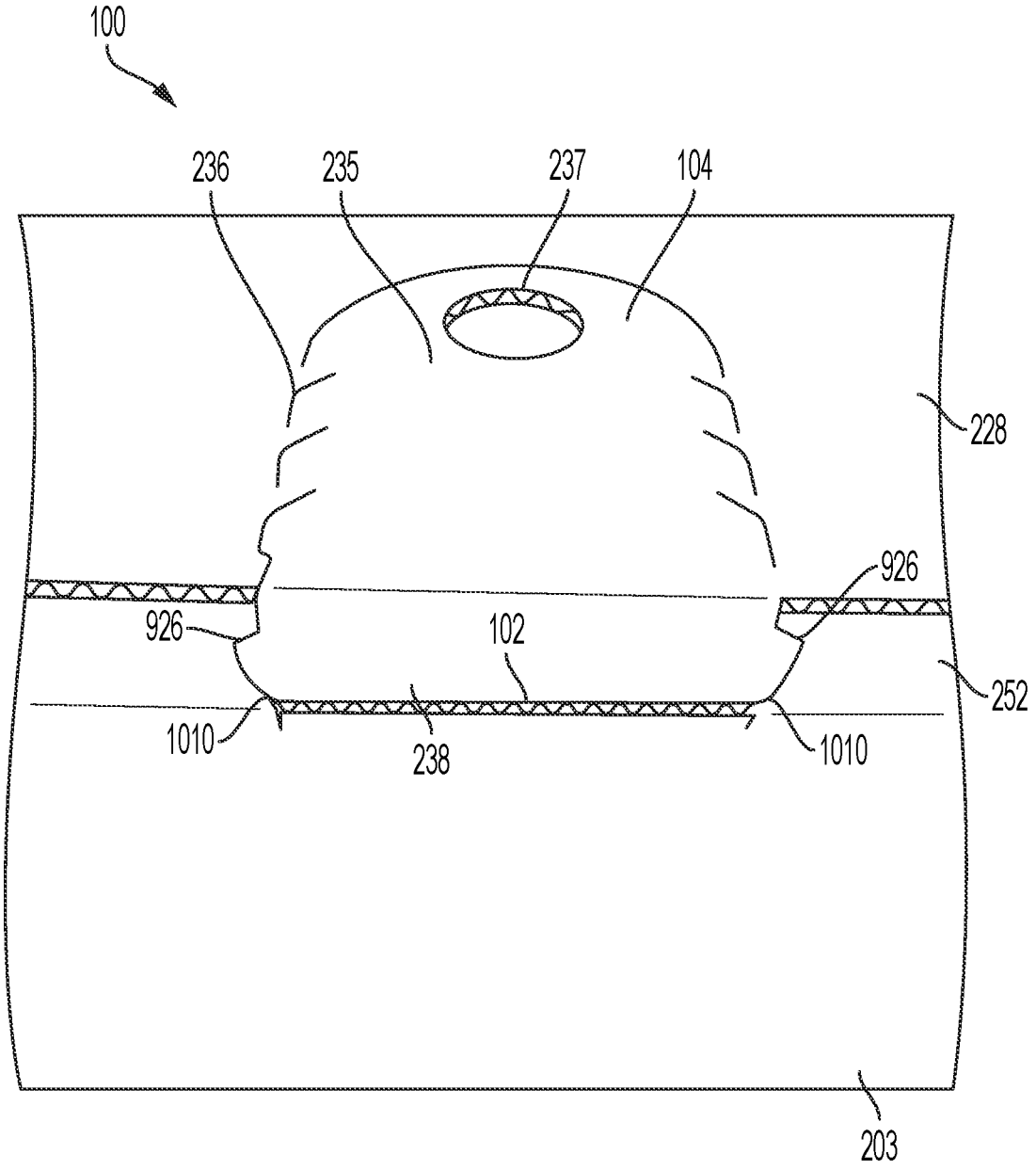
FIG. 10 is a bottom perspective view illustrating a fourth step in securing the shoebox of FIG. 1 in the closed and locked configuration.

FIG. 10 illustrates the locking tab 238 partially engaged with the locking slot 102. As shown, the locking slot 102 can define opposing slot edges 1010, and a slot width of the locking slot 102 can be defined between the opposing slot edges 1010. According to example aspects, the slot width of the locking slot 102 can be less than the tab width of the locking tab 238 at the locking shoulders 926. However, the locking shoulders 926 can be configured to bend slightly or otherwise deform to allow the locking shoulders 926 to be forced through the locking slot 102. Once received through the locking slot 102, the locking shoulders 926 can catch on the corresponding slot edges 1010 to prohibit the locking tab 238 from being withdrawn through the locking slot 102. Thus, the locking tab 238 can be in locking engagement with the locking slot 102 when fully inserted therethrough. With the locking tab 238 in locking engagement with the locking slot 102, the front panel 228 can be retained against the front connecting panel 252, and the first and second closure flaps 240,243 (shown in FIG. 2) can be retained within the first and second closure slots 810,910 (shown in FIGS. 8 and 9, respectively).

Figure 11:
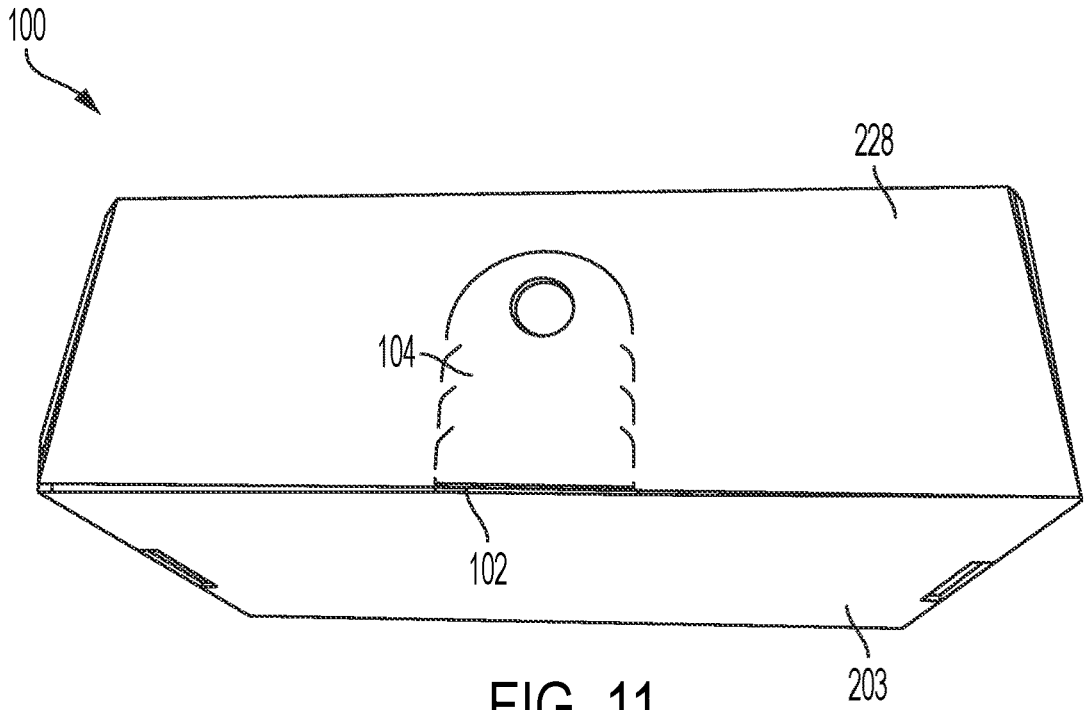
FIG. 11 is a bottom perspective view of the shoebox of FIG. 1 in the closed and locked configuration.

FIG. 11 illustrates the locking tab 238 (shown in FIG. 2) fully inserted through the locking slot 102 (i.e., the locking tab 238 in locking engagement with the locking slot 102) and the shoebox 100 in the closed and locked configuration. According to example aspects, in the locked configuration, the portion of the locking tab 238 (shown in FIG. 2) defined between the locking shoulders 926 (shown in FIG. 9) and the second tab end 922 (shown in FIG. 9) can be disposed within the interior 605 (shown in FIG. 6) of the shoebox 100, and the portion of the locking tab 238 defined by the tab notches 924 (shown in FIG. 9) can be disposed generally within the locking slot 102. In example aspects, the slot width of the locking slot 102 can be about equal to or greater than the tab width of the locking tab 238 at the tab notches 924. In the locked configuration of the shoebox 100, the shoebox 100 cannot be opened to access the interior 605 thereof without damaging the shoebox 100, such as by removal of tear strip 235. In this configuration, the shoebox 100 itself can be used as a secure and tamper-resistant shipping box for shipping the contents received therein, and end users can be confident that the shoebox 100 has not been opened if the shoebox 100 arrives undamaged. In other aspects, the shoebox 100 may not be used for shipping, and can serve as a secure storage box for the contents therein.

Figure 12:
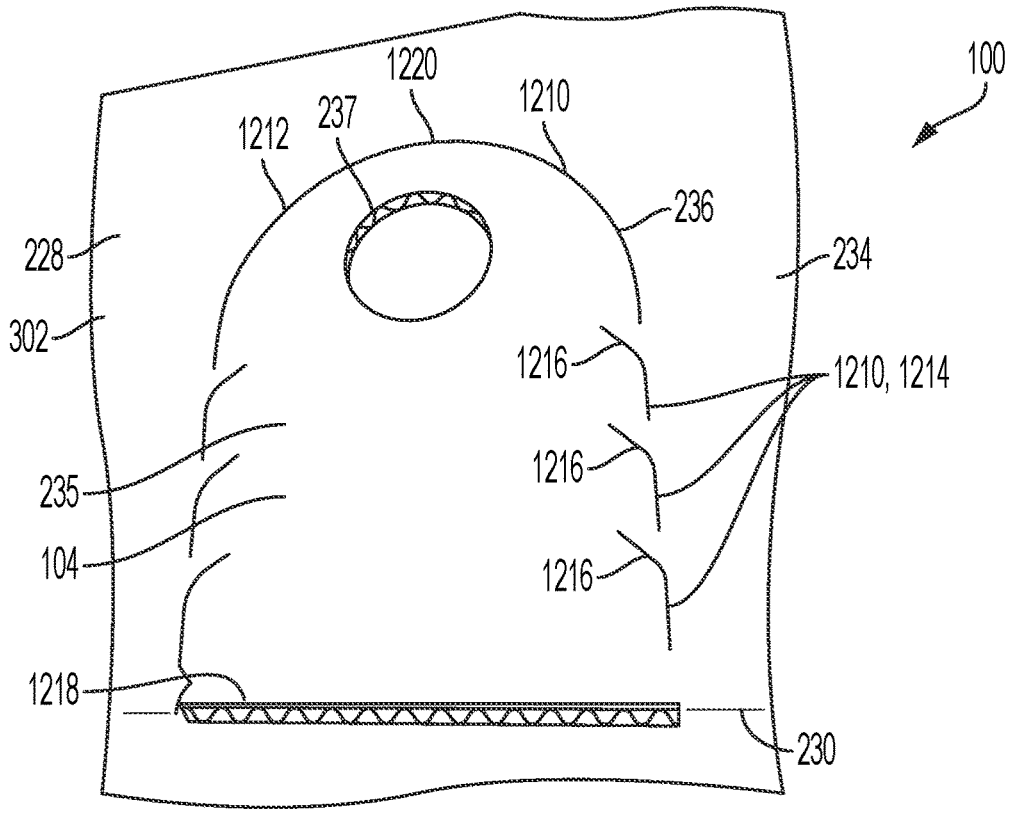
FIG. 12 is a detail view of a locking mechanism for securing the shoebox of FIG. 1 in the closed and locked configuration.

FIG. 12 is a detail view of the tear strip 235, with the shoebox 100 in the closed and locked configuration. As shown, the tear strip 235 of the tearaway portion 104 can be formed with the front panel 228. In example aspects, the tear strip 235 can be defined by the tear line 236 extending into the front panel 228 at the front lower end 230 thereof. For example, in the present aspect, the tear line 236 can be formed by cutting the front panel 228 to define a plurality of perforations 1210 therethrough. However, in other aspects, the tear line 236 can formed by any other suitable method known in the art, such as by scoring to define one or more superficial slits in the inner surface 201 (shown in FIG. 2) and/or the outer surface 302 of the shoebox 100. The tear strip 235 can define a proximal strip end 1218 generally at the front lower end 230 of the front panel 228, and a distal strip end 1220 opposite the proximal strip end 1218. To unlock the shoebox 100, the tear strip 235 can be torn away from the surrounding front panel body 234 in the direction from the distal strip end 1220 to the proximal strip end 1218, as described in further detail below. In some aspects, some or all of the perforations 1210 can be shaped to optimize tearing along the tear line 236 in the desired direction. In the present aspect, the perforations 1210 can comprise an elongated, arcuate perforation 1212 defined at the distal strip end 1220 and a plurality of short perforations 1214 extending between the arcuate perforation 1212 and the proximal strip end 1218. A distal, angled portion 1216 of each of the short perforations 1214 can angle into the tear strip 235 in the direction of the distal strip end 1220. In other aspects, the perforations 1210 can define any other suitable shape and configuration.

According to example aspects, the engagement opening 237 can be formed through the tear strip 235, and in the present aspect, the engagement opening 237 can be arranged proximate to the distal strip end 1220. However, in other aspects, the engagement opening 237 can be arranged more centrally between the distal strip end 1220 and the proximal strip end 1218, or the engagement opening 237 can be arranged closer to the proximal strip end 1218. In some aspects, the tear strip 235 can be scored to define a punch portion, and the punch portion can be punched out of the tear strip 235 to form the engagement opening 237. For example, the punch portion can be removed when it is desired to utilize the engagement opening 237 to open the shoebox 100. The engagement opening 237 can be substantially circular in the present aspect, but in other aspects, the engagement opening 237 can define any other suitable shape in other aspects. Other aspects of the tear strip 235 may not comprise the engagement opening 237, and the tear line 236 can be torn by pressing the tear strip 235 and/or the tear line 236 inward.

Figure 13:
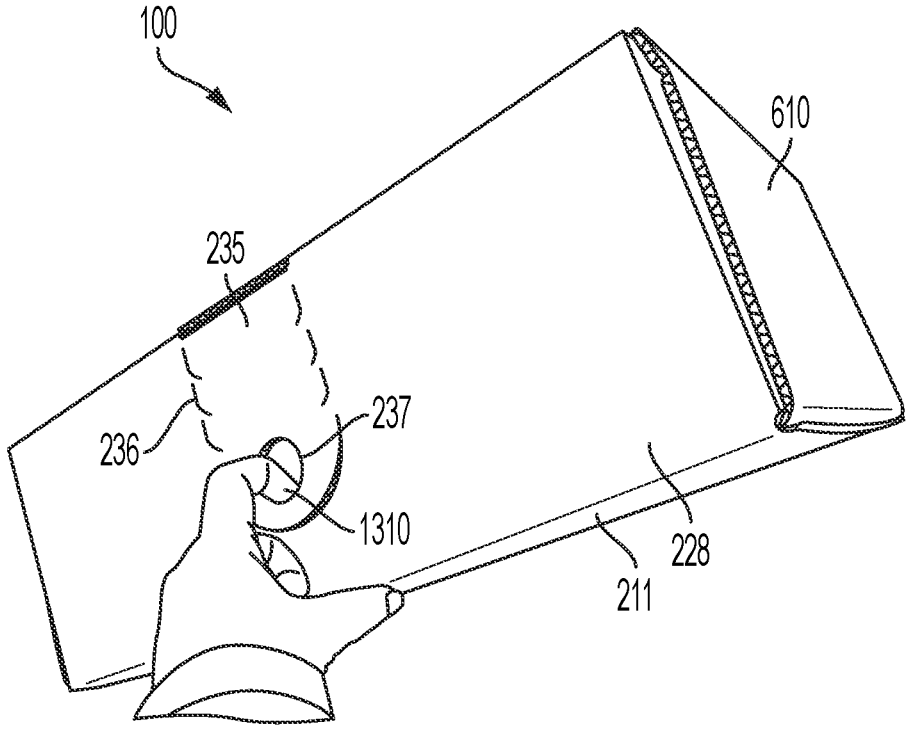
FIG. 13 is a front perspective view illustrating a first step in unlocking the shoebox of FIG. 1.
Figure 14:
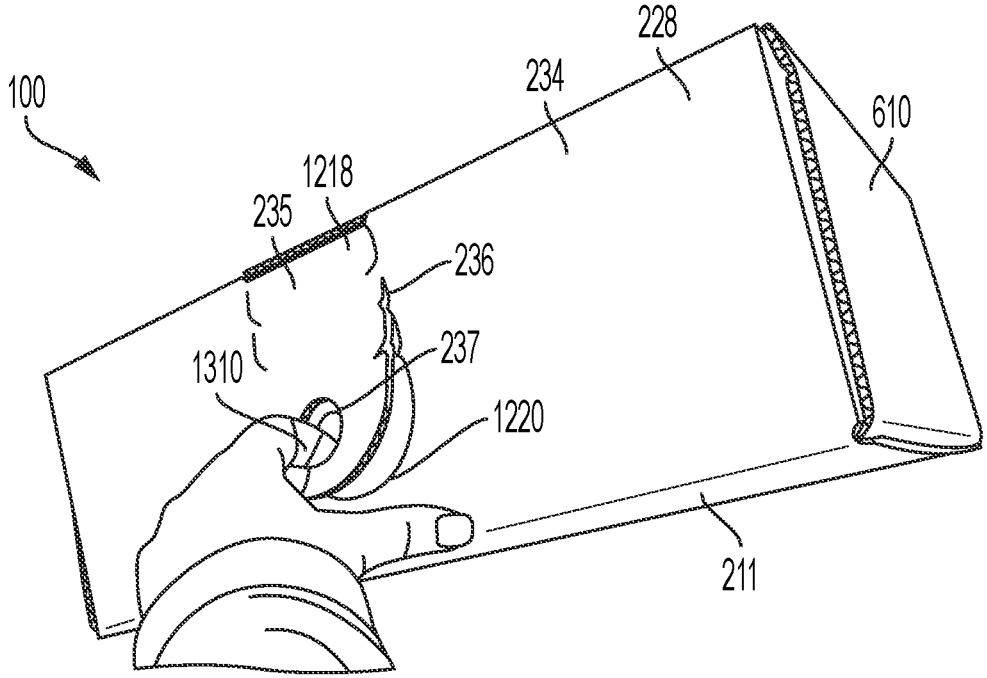
FIG. 14 is a front perspective view illustrating a second step in unlocking the shoebox of FIG. 1.
Figure 15:
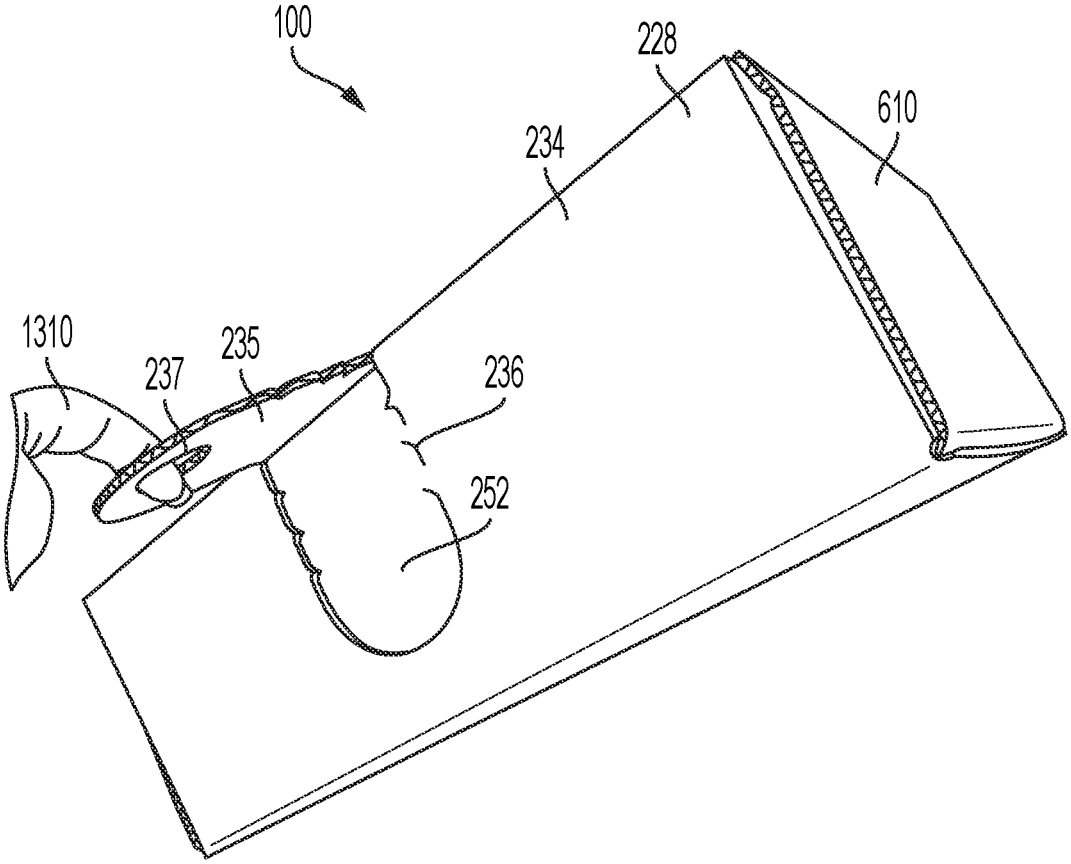
FIG. 15 is a front perspective view of the shoebox of FIG. 1 in a closed and unlocked configuration.

FIG. 13 illustrates a first step of unlocking the shoebox 100. As shown, a user can manually engage the engagement opening 237 of the tear strip 235 such as by inserting a finger 1310 or fingers therethrough. As shown in FIG. 14, the user can grip the tear strip 235 with their finger(s) 1310 and can begin to pull the tear strip 235 away from the front panel body 234 of the front panel 228 at the distal strip end 1220. The tear line 236 can rip under the application of a suitable manual force to allow the tear strip 235 to be torn away in the direction from the distal strip end 1220 to the proximal strip end 1218. As shown in FIG. 15, the entire tear line 236 can be ripped to completely detach the tear strip 235 from the front panel body 234. Once the tear strip 235 is detached from the front panel body 234, the shoebox 100 can be in the unlocked and closed configuration. In the unlocked configuration, the shoebox 100 can be opened without interference from the locking tab 238 (shown in FIG. 2).

Figure 16:
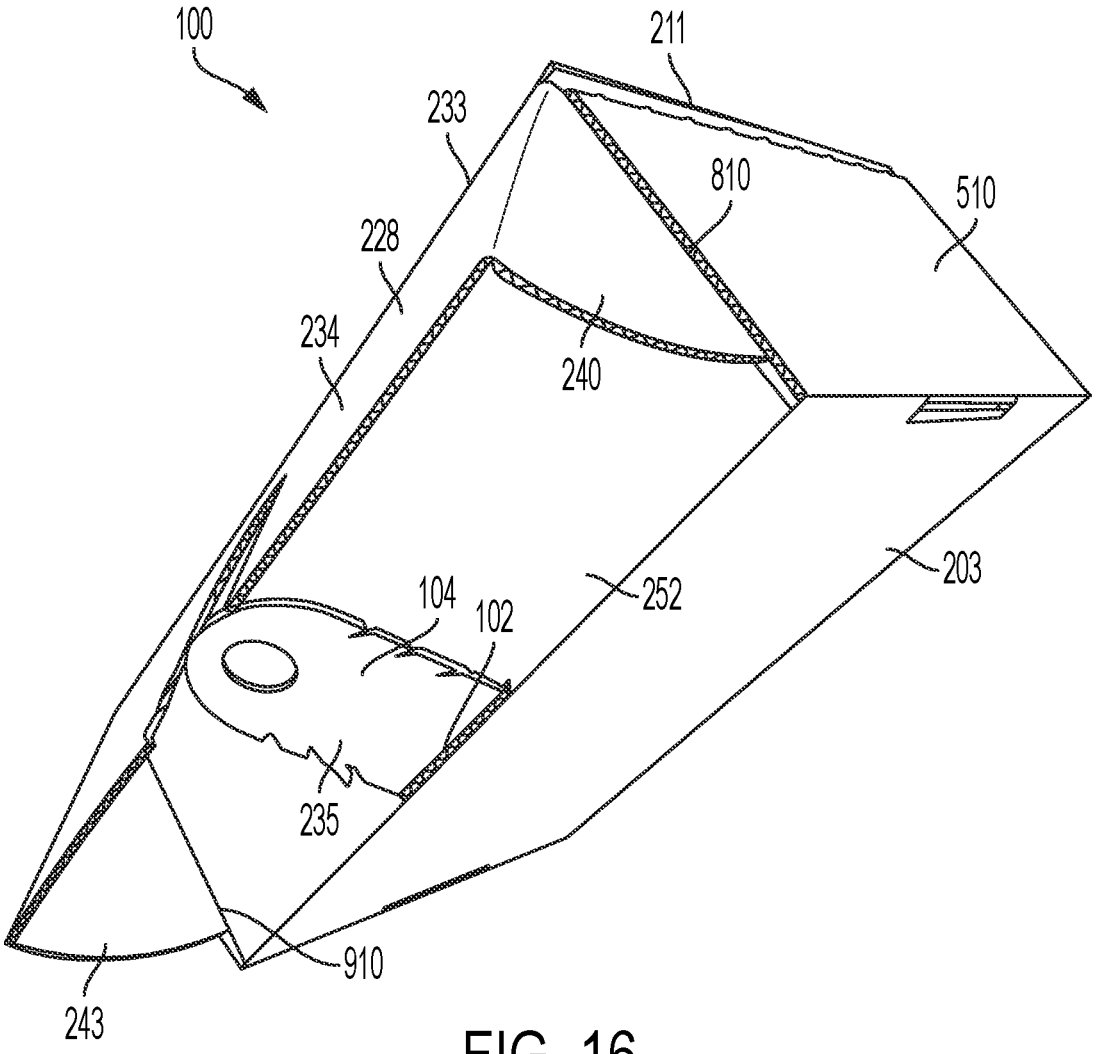
FIG. 16 is a bottom perspective view of the unlocked shoebox of FIG. 1 being opened.

FIG. 16 illustrates a first step in opening the shoebox 100 after it has been unlocked. To open the shoebox 100, the front panel 228 can be folded outward and away from the front connecting panel 252 at the front bend line 233. As the front panel 228 is folded outward, the first and second closure flaps 240,243 can be drawn out of the corresponding first and second closure slots 810,910. The locking tab 238 (shown in FIG. 2) of the tearaway portion 104 can remain in locking engagement with the locking slot 102, but the detachment of the tear strip 235 from the front panel body 234 can allow the front panel 228 to fold freely outward. The upper main panel 211 and the secondary upper panel 246 (shown in FIG. 2) can then be folded outward and away from the interior 605 (shown in FIG. 6) of the shoebox 100 to uncover the shoebox opening 630 (shown in FIG. 6) and allow access to the contents received in the interior 605.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A shoebox comprising:

a first main panel;

a second main panel opposite the first main panel;

a first connecting panel extending from the first main panel, the first connecting panel defining a locking slot;

a second connecting panel extending between the first main panel and the second main panel opposite the first connecting panel;

an overlapping panel having a front upper end and a front lower end opposite the front upper end, the front upper end of the overlapping panel being connected to the second main panel, and the overlapping panel extending from the second connecting panel and at least partially overlapping the first connecting panel; and a locking tab extending from the front lower end of the overlapping panel, the locking tab in locking engagement with the locking slot in a closed and locked configuration of the shoebox, wherein:

the shoebox comprises a tearaway portion;

the tearaway portion comprising the locking tab;

the tearaway portion is attached to a panel body of the overlapping panel in the closed and locked configuration;

the tearaway portion is detached from the panel body in an unlocked configuration of the shoebox;

the tearaway portion further comprises a tear strip formed with the overlapping panel, the tear strip defined by a tear line formed in the overlapping panel, the locking tab hingedly connected to the tear strip; and an engagement opening is formed through the tear strip, the engagement opening configured to be manually engaged to pull the tear strip away from the panel body of the overlapping panel to reconfigure the shoebox from the closed and locked configuration to the unlocked configuration.

2. The shoebox of claim 1, wherein:

the locking tab defines at least one locking shoulder;

a width of the locking tab at the locking shoulder is greater than a width of the locking slot; and the locking slot is configured to catch on a slot edge of the locking slot to prohibit withdrawal of the locking tab from the locking slot.

3. The shoebox of claim 2, wherein the locking tab defines a first tab end at the overlapping panel and a second tab end distal to the first tab end, and wherein the width of the locking tab tapers generally from the locking shoulder to the second tab end to facilitate engagement of the locking tab with the locking slot.

4. The shoebox of claim 2, wherein the locking slot is formed through the first connecting panel adjacent to the first main panel.

5. The shoebox of claim 1, wherein:

the shoebox further comprises a first side wall and a second side wall opposite the first side wall;

each of the first side wall and second side wall extends substantially from the first connecting panel to the second connecting panel;

the first side wall defines a first closure slot and the second side wall defines a second closure slot;

a first closure flap extends from the overlapping panel and engages the first closure slot; and a second closure flap extends from the overlapping panel and engages the second closure slot.

6. The shoebox of claim 5, wherein each of the first side wall and the second side wall comprises an inner side panel and an outer side panel, the inner side panel extending from the first main panel, the outer side panel extending from the inner side panel distal to the first main panel and folded relative to the inner side panel about 180°, the outer side panel defining an engagement tab, the engagement tab engaging an engagement slot formed through the first main panel.

7. The shoebox of claim 6, wherein:

a first connecting flap extends from each of the first connecting panel and the second connecting panel;

a second connecting flap extends from each of the first connecting panel and the second connecting panel;

each of the first connecting flaps are disposed between the inner side panel of the first side wall and the outer side panel of the first side wall; and each of the second connecting flaps are disposed between the inner side panel of the second side wall and the outer side panel of the second side wall.

8. The shoebox of claim 1, wherein:

the shoebox defines an interior and a shoebox opening allowing access to the interior;

the second main panel substantially covers the shoebox opening in the closed and locked configuration;

the shoebox further comprises a secondary panel extending from the first connecting panel and substantially covering the shoebox opening in the closed and locked configuration; and one of the second main panel and the secondary panel overlaps the other of the second main panel and the secondary panel.

9. A shoebox blank comprising:

a first main panel defining a first end and a second end opposite the first end;

a second main panel defining a first end and a second end opposite the first end;

a first connecting panel extending from and hingedly connected to the first end of the first main panel, the first connecting panel defining a locking slot;

a second connecting panel extending between and hingedly connected to each of the second end of the first main panel and the second end of the second main panel;

an overlapping panel having a front upper end and a front lower end, the overlapping panel extending from and hingedly connected to the first end of the second main panel at the front upper end of the overlapping panel; and a locking tab extending from the front lower end of the overlapping panel;

wherein:

the shoebox blank comprises a tearaway portion attached to a panel body of the overlapping panel, the tearaway portion comprising the locking tab, the tearaway portion configured to be detached from the panel body;

the tearaway portion further comprises a tear strip formed with the overlapping panel, the tear strip defined by a tear line formed in the overlapping panel, the locking tab hingedly connected to the tear strip at a tab bend line; and an engagement opening is formed through the tear strip, the engagement opening configured to be manually engaged to pull the tear strip away from the panel body of the overlapping panel.

10. The shoebox blank of claim 9, wherein the locking tab defines at least one locking shoulder, and wherein width of the locking tab at the locking shoulder is greater than a width of the locking slot.

11. The shoebox blank of claim 10, wherein the locking tab defines a first tab end at the tab bend line and a second tab end distal to the first tab end, and wherein the width of the locking tab tapers generally from the locking shoulder to the second tab end.

12. The shoebox blank of claim 10, wherein the locking slot is formed through the first connecting panel proximate to the first main panel.

13. The shoebox blank of claim 9, further comprising a first closure flap extending from and hingedly connected to a first side of the overlapping panel and a second closure flap extending from and hingedly connected to a second side of the overlapping panel opposite the first side.

14. The shoebox blank of claim 9, further comprising:

a first inner side panel extending from and hingedly connected to a first side of the first main panel;

a first outer side panel defining a first engagement tab and extending from and hingedly connected to the first inner side panel opposite the first main panel;

a second inner side panel extending from and hingedly connected to a second side of the first main panel opposite the first side; and a second outer side panel defining a second engagement tab and extending from and hingedly connected to the second inner side panel opposite the first main panel.

15. The shoebox blank of claim 14, further comprising:

a first connecting flap extending from and hingedly connected to a first side of each of the first connecting panel and the second connecting panel; and a second connecting flap extending from and hingedly connected to a second side of each of the first connecting panel and the second connecting panel opposite the first side.

16. The shoebox blank of claim 9, further comprising a secondary panel extending from and hingedly connected to the first connecting panel opposite the first main panel.

17. A shoebox comprising:

a first main panel;

a second main panel opposite the first main panel;

a first connecting panel extending from the first main panel, the first connecting panel defining a locking slot;

a second connecting panel extending between the first main panel and the second main panel opposite the first connecting panel;

an overlapping panel having a front upper end and a front lower end opposite the front upper end, the front upper end of the overlapping panel being connected to the second main panel, and the overlapping panel extending from the second connecting panel and at least partially overlapping the first connecting panel; and a locking tab extending from the front lower end of the overlapping panel, the locking tab in locking engagement with the locking slot in a closed and locked configuration of the shoebox;

wherein:

the shoebox further comprises a first side wall and a second side wall opposite the first side wall;

each of the first side wall and second side wall extends substantially from the first connecting panel to the second connecting panel;

the first side wall defines a first closure slot and the second side wall defines a second closure slot;

a first closure flap extends from the overlapping panel and engages the first closure slot; and a second closure flap extends from the overlapping panel and engages the second closure slot.

18. The shoebox of claim 17, wherein each of the first side wall and the second side wall comprises an inner side panel and an outer side panel, the inner side panel extending from the first main panel, the outer side panel extending from the inner side panel distal to the first main panel and folded relative to the inner side panel about 180°, the outer side panel defining an engagement tab, the engagement tab engaging an engagement slot formed through the first main panel.

19. The shoebox of claim 18, wherein:

a first connecting flap extends from each of the first connecting panel and the second connecting panel;

a second connecting flap extends from each of the first connecting panel and the second connecting panel;

each of the first connecting flaps are disposed between the inner side panel of the first side wall and the outer side panel of the first side wall; and each of the second connecting flaps are disposed between the inner side panel of the second side wall and the outer side panel of the second side wall.

* * * * *